US012012248B2

(12) United States Patent
McNair et al.

(10) Patent No.: US 12,012,248 B2
(45) Date of Patent: Jun. 18, 2024

(54) BAG SEALING SYSTEMS, METHODS AND APPARATUS

(71) Applicant: Suzohapp, Inc., Schaumburg, IL (US)

(72) Inventors: David McNair, Toolern Vale (AU); Tim Patrick Moergenthaler, Cremorne (AU); Pierre Nicolas, Ringwood (AU); Robert Bruce Tenney, Reservoir (AU); Clare Emily Scott, Croydon Nth (AU); Ian De Dominicis, Griffin (AU)

(73) Assignee: Suzohapp, Inc., Schaumburg, IL (US)

( * ) Notice: Subject to any disclaimer, the term of this patent is extended or adjusted under 35 U.S.C. 154(b) by 1 day.

(21) Appl. No.: 17/901,233

(22) Filed: Sep. 1, 2022

(65) Prior Publication Data

US 2024/0076075 A1 Mar. 7, 2024

(51) Int. Cl.
*B65B 7/06* (2006.01)

(52) U.S. Cl.
CPC ..... *B65B 7/06* (2013.01)

(58) Field of Classification Search
CPC ..... B65B 7/06
See application file for complete search history.

(56) References Cited

U.S. PATENT DOCUMENTS 1,726,060 A * 8/1929 Doble ..... B65B 29/028 53/577
1,857,662 A * 5/1932 Rohrig ..... B65B 29/028 53/134.2
2,328,639 A * 9/1943 Gaertner ..... B65B 29/04 53/134.2
3,688,379 A * 9/1972 Davis ..... D06F 95/004 29/241
3,825,039 A * 7/1974 Crabb ..... B65B 51/08 53/138.8
3,940,169 A * 2/1976 Kock ..... A61F 13/2085 289/1.5
4,200,127 A * 4/1980 Dunleavy ..... B65B 67/1238 141/10
5,016,844 A * 5/1991 Garvin ..... B65B 67/12 248/150
5,118,054 A * 6/1992 Kirschenbaum ..... A63H 27/10 D21/445
6,892,511 B2 * 5/2005 Wagner ..... B65B 67/08 53/390
8,684,160 B2 * 4/2014 Hallowell ..... G06Q 20/18 194/344
10,513,391 B1 * 12/2019 Sosan ..... B65F 1/16
(Continued)

FOREIGN PATENT DOCUMENTS

AU 2018427688 B2 9/2018
WO 2020/245462 A1 12/2020

*Primary Examiner* — Thomas M Wittenschlaeger
(74) *Attorney, Agent, or Firm* — Workman Nydegger

(57) ABSTRACT

A bag sealing system for securing one or more items in a closable bag comprises a moveable frame, a closable bag, a closing device and a driving device. The moveable frame can have an open configuration, intermediate configurations and a closed configuration. The closable bag has an open end and a closed end wherein the open end of the closable bag is coupled to the moveable frame. The closing device is provided for securely closing the open end of the bag via a securing element, and the driving device is coupled to the closing device to actuate the closing device to securely close the closable bag.

21 Claims, 22 Drawing Sheets

(56) References Cited

U.S. PATENT DOCUMENTS

| | | | | |
|---|---|---|---|---|
| 10,516,258 | B2 * | 12/2019 | Ebrahimi Afrouzi | B65H 75/4428 |
| 10,865,041 | B2 * | 12/2020 | Li | B65F 1/1415 |
| 11,412,876 | B1 * | 8/2022 | Kadlub | A47G 29/20 |
| 11,559,109 | B2 * | 1/2023 | Schneider | A43C 11/165 |
| 2007/0084142 | A1 * | 4/2007 | Matthews | B65B 9/20 53/139.2 |
| 2010/0083612 | A1 * | 4/2010 | Frazier | B65B 51/08 53/138.8 |
| 2017/0265580 | A1 * | 9/2017 | Schneider | A43C 11/165 |
| 2019/0382197 | A1 * | 12/2019 | Li | B65F 1/1415 |
| 2020/0388095 | A1 * | 12/2020 | Agbeyo | H04W 4/80 |

* cited by examiner

BAG SEALING SYSTEMS, METHODS AND APPARATUS

FIELD OF THE INVENTION

The present invention relates generally to bag sealing systems, methods and apparatus for securing one or more items in a closable bag.

The invention has been developed primarily for receiving and securing valuables in a closable bag and will be described hereinafter with reference to this application. However, it will be appreciated that the invention is not limited to this particular field of use.

BACKGROUND

Any discussion of the prior art throughout the specification should in no way be considered as an admission that such prior art is widely known or forms part of the common general knowledge in the relevant technical field or art.

The ability to store valuables, such as currencies, or dangerous items, such as medical waste, securely is paramount in many applications. For example, valuables, whether coins, bank notes or other valuable items, are typically stored in sealed bags before being transported, for instance from their collection points to a storage facility. Examples include the secure storage of cash in gaming machines and money sorting applications. During retrieval and/or transportation an operator might be tempted to alter the bag contents without being noticed. Tamper proof sealing methods have been developed in an effort to prevent this from occurring. However, at least some of these tamper proof sealing methods can be defeated without being noticed. For other applications, specific, bespoke solutions must be developed, which can be costly.

OBJECT OF THE INVENTION

It is an object of the present invention to overcome and/or alleviate one or more of the aforementioned disadvantages of the prior art and/or provide the consumer with a useful or commercial choice.

SUMMARY OF THE INVENTION

In one aspect, the invention resides in a bag sealing system for securing one or more items in a closable bag, the system comprising: a moveable frame, having an open configuration and a closed configuration; a closable bag having an open end and a closed end wherein the open end of the closable bag is coupled to the moveable frame; a closing device for securely closing the open end of the bag; and a driving device coupled to the closing device to actuate the closing device to securely close the closable bag.

Preferably, actuation of the closing device to securely close the closable bag moves at least part of the moveable frame from the open configuration to the closed configuration.

Preferably, the closable bag comprises a securing element for securely closing the open end of the bag.

Preferably, the securing element is an elongate member provided about the perimeter of the open end of the closable bag.

Suitably, the elongate member is at least partially embedded in a neck portion of the closable bag.

In some embodiments, the elongate member is provided in a sealed channel provided about the perimeter of the open end of the closable bag.

Suitably, a distal end of the elongate member is attached to the closable bag and a proximal end of the elongate member is attached to the closing device.

In some embodiments, a loop member is provided at the distal end of the elongate member. The loop member may surround a portion of the elongate member in between the proximal and distal ends of the elongate member. Preferably, the proximal end of the elongate member is attached to the closing device.

In some embodiments, both a distal end and a proximal end of the elongate member are attached to the closing device.

Suitably, the elongate member is selected from a group including a string, a thread, a rope, a cable, a chain, a cable tie, and a wire.

Preferably, the closing device comprises a rotatable spool in a housing for storing a portion of the securing element.

Suitably, the rotatable spool comprises one or more of the following: at least one volume, space or void, in particular, in the form of a channel about its circumference for storing the elongate member; at least one attachment element for attaching the proximal end of the elongate member or both the proximal and distal ends of the elongate member, wherein the at least one attachment point is provided in the at least one channel; a first set of pawls; and a coupling element for coupling to the driving device.

Suitably, the housing comprises one or more of the following: at least one aperture for allowing the elongate member to pass through the housing, and wherein the at least one aperture is provided substantially in front of the at least one channel; and a second set of pawls, wherein the first set of pawls engages with the second set of pawls.

Preferably, the rotatable spool is rotatable in the housing only in one direction, but in some embodiments the spool may be rotatable in both or more than one direction.

Suitably, the driving device is selected from a group including an electric motor, a magnetic actuator or a manual actuator.

Suitably, the movable frame comprises one or more of the following: a plurality of moveable elements; a plurality of static elements, wherein the plurality of moveable elements move relative to the plurality of static elements; a plurality of securing parts with securing hooks for receiving the securing element, wherein the plurality of securing parts are connected to the plurality of moving elements; and a closing device holder wherein the closing device holder is connected to the closing device and the driving device.

Preferably, the securing hooks for receiving the securing element are self-releasing to release the securing element upon closing the closable bag.

In some embodiments, the open configuration of the movable frame has a quadrilateral footprint. In other embodiments, the open configuration can have a footprint in another shape, such as, but not limited to circular or substantially circular.

In another aspect, the invention resides in a method of securing one or more items in a bag in a bag sealing system, the method comprising the steps of: receiving the one or more items in a closable bag having an open end and a closed end, wherein the open end of the closable bag is coupled to a moveable frame; and actuating a closing device with a driving device thereby storing a portion of a securing element of the closable bag in the closing device to securely close the closable bag.

Preferably, closing the closable bag moves the moveable frame from an open configuration to a closed configuration.

In another aspect, the invention resides in a closing device for closing a closable bag, the closing device comprising: a housing having at least one aperture allowing the passage therethrough of a securing element, and a spool rotatable in the housing for storing a portion of the securing element, the spool comprising at least one aperture for receiving the securing element.

Suitably, the closing device comprises one or more of the following: the spool comprises two half portions; the spool comprises at least one inner spool channel for securing the securing element to the spool; the spool comprises a coupling element for connecting a driving element to the spool; the coupling element is shaped as a helicoidal screw; the spool comprises a first set of pawls which engage with a second set of pawls on an inside of the housing allowing the spool to rotate in the housing only in one direction; a locking member for securing the spool into the housing; at least one recess region provided in the locking member allowing the securing element to pass through the locking member when the spool is inserted into the housing.

In another aspect, the invention resides in a closable bag for securing contents, the closable bag comprising: an open end and a closed end, and a securing element positioned for securely closing the open end of the closable bag, wherein the securing element is provided about a perimeter of the open end of the closable bag.

Preferably, the closable bag further comprises the securing device of the previous aspect.

Further aspects and/or features of the present invention will become apparent from the detailed description with reference to the drawings.

BRIEF DESCRIPTION OF THE DRAWINGS

To assist in understanding the invention and to enable a person skilled in the art to put the invention into practical effect, preferred embodiments of the invention are described below by way of example only with reference to the accompanying drawings, in which.

Figure 1:
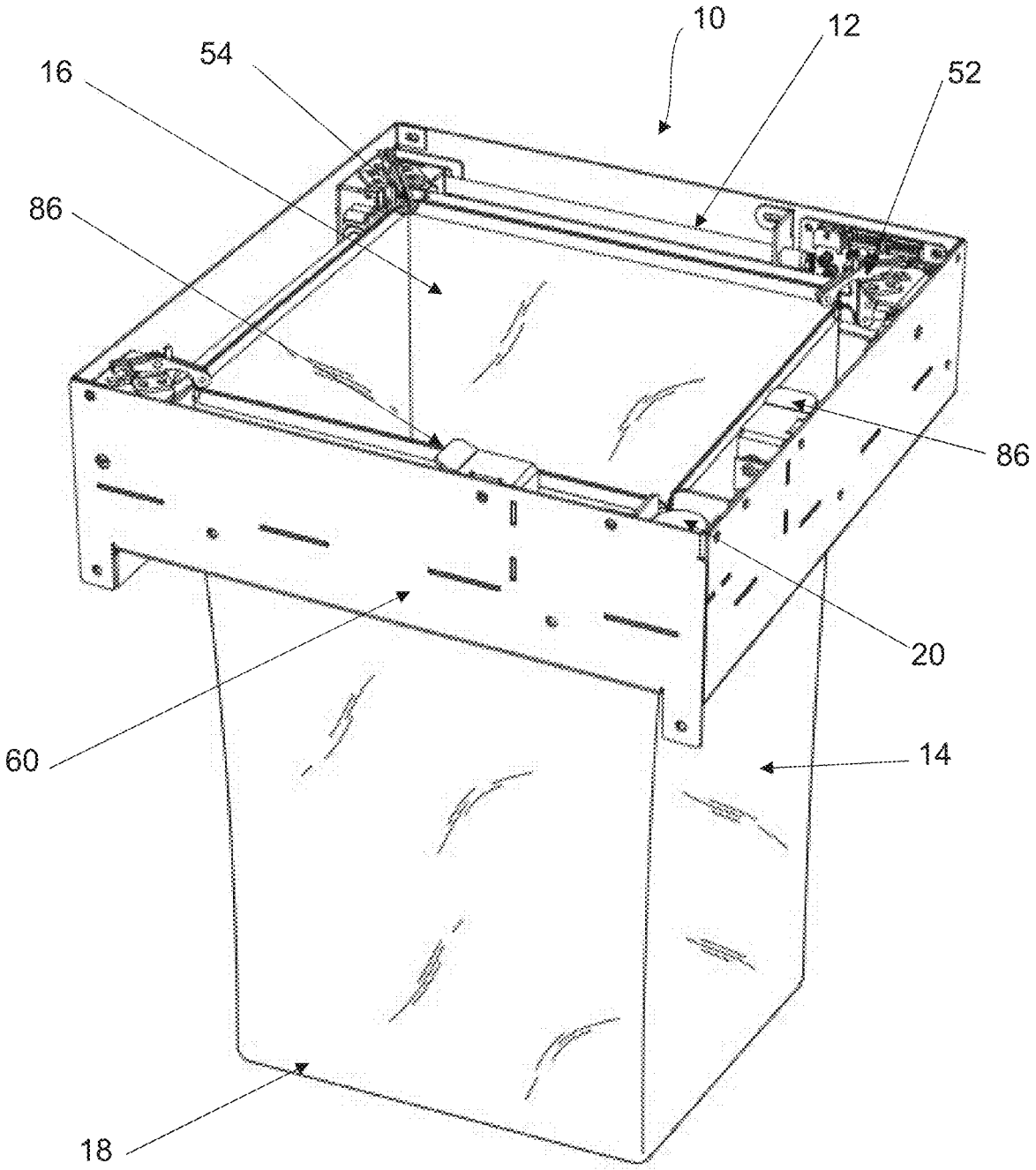
FIG. 1 shows a top perspective view of the bag sealing system for securing one or more items in a closable bag with the bag open.

It should be appreciated that the accompanying drawings are provided to illustrate the features of the invention and some other features may have been omitted for the sake of clarity and/or the drawings may be schematic and/or diagrammatic.

DETAILED DESCRIPTION OF THE PREFERRED EMBODIMENT

The present invention relates to bag sealing systems, methods and apparatus for securing one or more items in a closable bag. Elements of the invention are illustrated in concise outline form in the drawings, showing only those specific details that are necessary to understanding the embodiments of the present invention, but so as not to clutter the disclosure with excessive detail that will be obvious to those of ordinary skill in the art in light of the present description.

In this patent specification, adjectives such as first and second, left and right, above and below, top and bottom, upper and lower, rises and falls, upward and downward, etc., are used solely to define one element or method step from another element or method step without necessarily requiring a specific relative position or sequence that is described by the adjectives. Words such as "comprises" or "includes" are not used to define an exclusive set of elements or method steps. Rather, such words merely define a minimum set of elements or method steps included in a particular embodiment of the present invention.

According to one aspect, embodiments of the invention reside in a bag sealing system for securing one or more items in a closable bag. The system comprises a moveable frame having an open configuration and a closed configuration, and a closable bag having an open end and a closed end. The open end of the closable bag is coupled to the moveable frame. The system also comprises a closing device for securely closing the open end of the bag, and a driving device coupled to the closing device to actuate the closing device to securely close the closable bag.

FIG. 1 is a top perspective view of the bag sealing system 10 for securing one or more items in a closable bag 14, showing the bag open or in an open configuration. The bag sealing system 10 includes a moveable frame 12 and a closable bag 14, both shown in the open configuration. The closable bag has an open end 16 and a closed end 18. A closing device 20, actuated by a driving device 22 (shown in FIG. 10), is also provided for securely closing the closable bag 14. The driving device 22 can be an electric motor, a magnetic actuator, a manual actuator, such as a rotatable handle, or any other device enabling the actuation of the closing device 20. FIG. 1 also shows a plurality of securing parts 52, which in this embodiment, are in the form of securing hooks 54. The securing hooks 54 hold the closable bag 14 and are triggered to release the bag 14 by triggering elements 86. This will be described in further detail herein. FIG. 1 further shows the bag sealing system 10 mounted in a mounting frame comprising side walls 60, which will be described in further detail herein.

Figure 2:
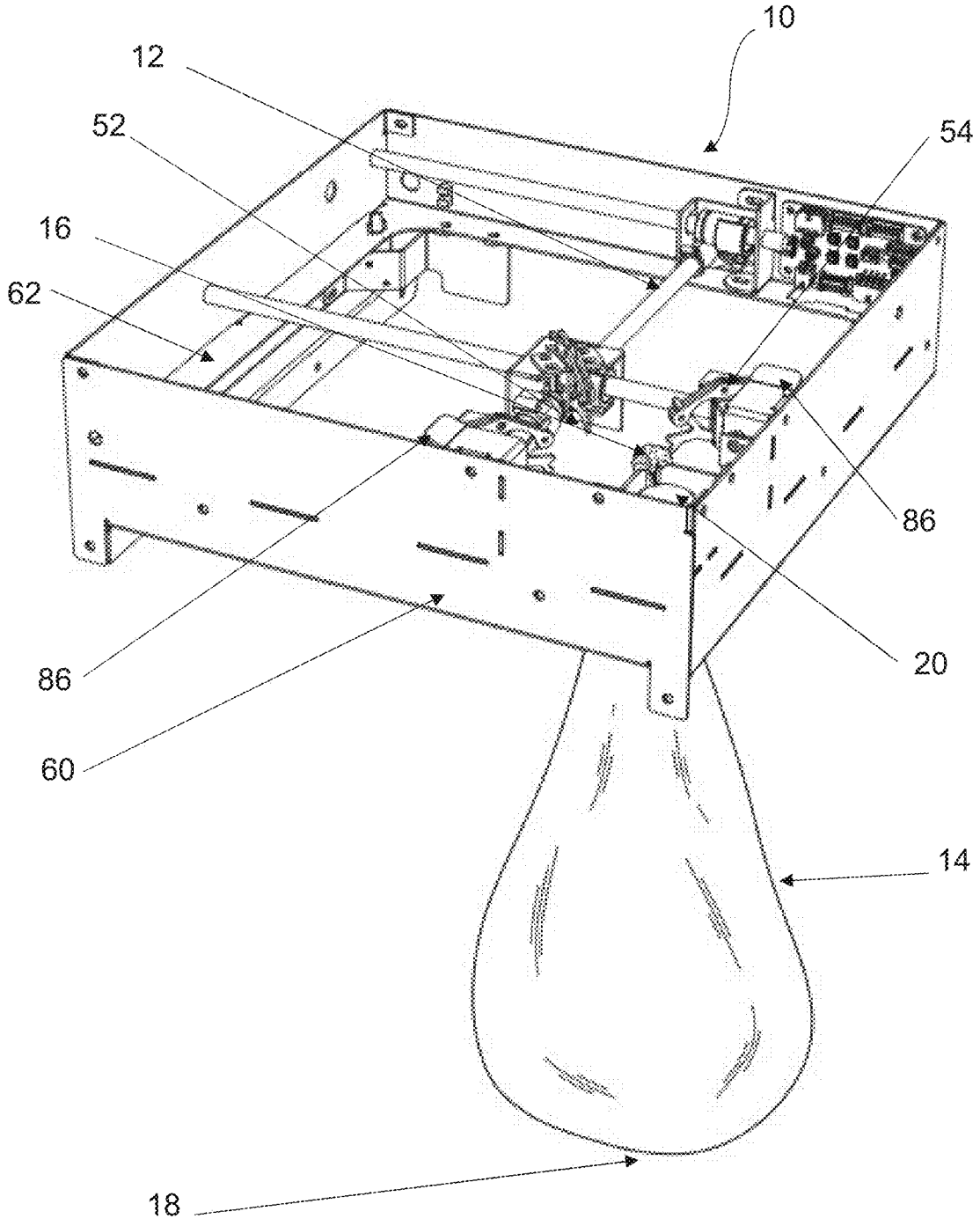
FIG. 2 shows a top perspective view of the bag sealing system for securing one or more items in a closable bag with the bag closed.

FIG. 2 shows another top perspective view of the bag sealing system 10, wherein the closable bag 14 is in a closed configuration. The movable frame 12 has also transitioned from its open configuration shown in FIG. 1 to a closed configuration and then to a partially closed configuration shown in FIG. 2. The change of configuration of the moveable frame accompanies the closing of the closable bag 14, upon actuation of the closing device 20 by the driving device 22. FIG. 2 shows the securing hooks 54 released from the closable bag 14.

Figure 3:
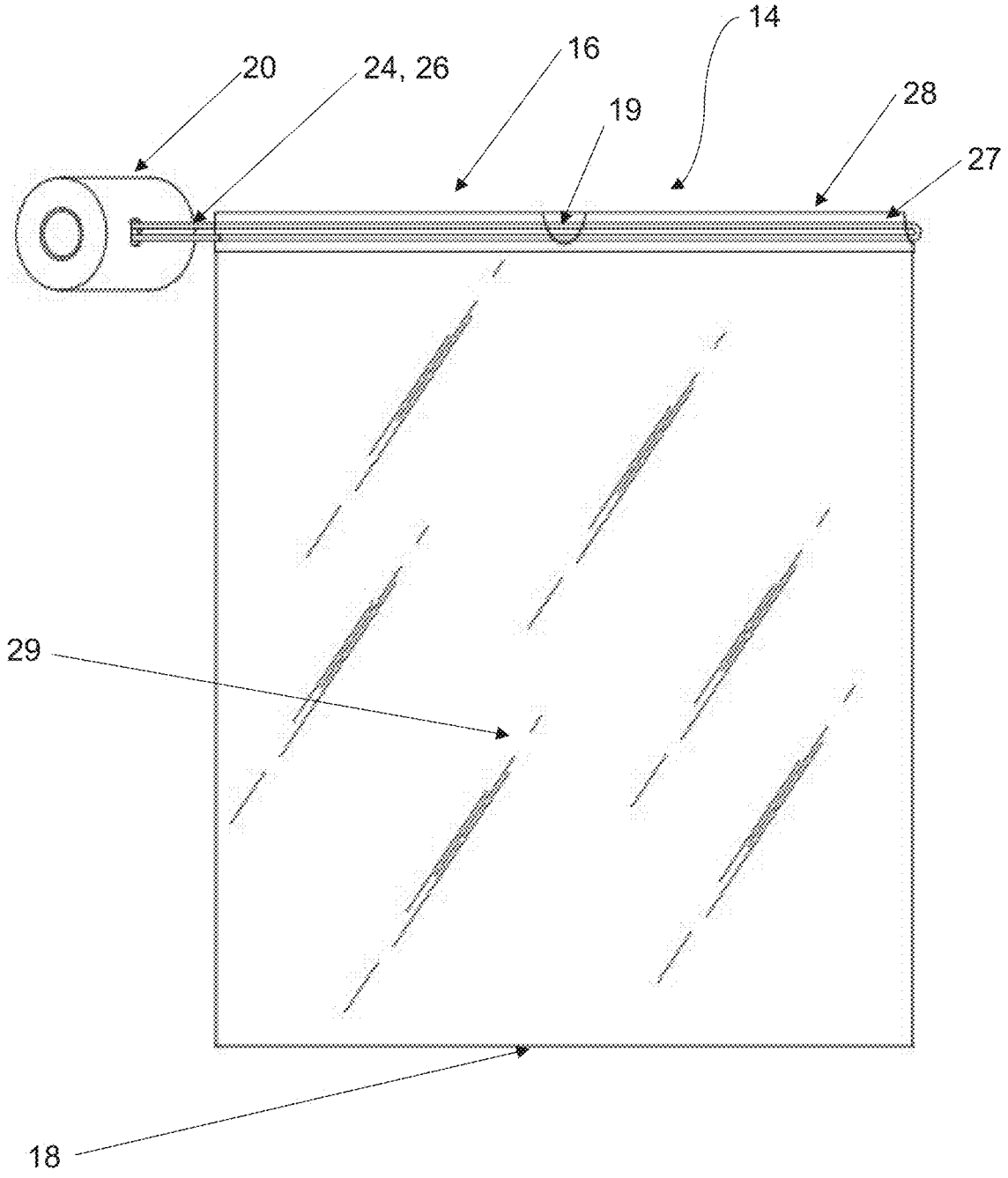
FIG. 3 shows a side view of a top part of the closable bag with a securing element and a closing device.
Figure 4:
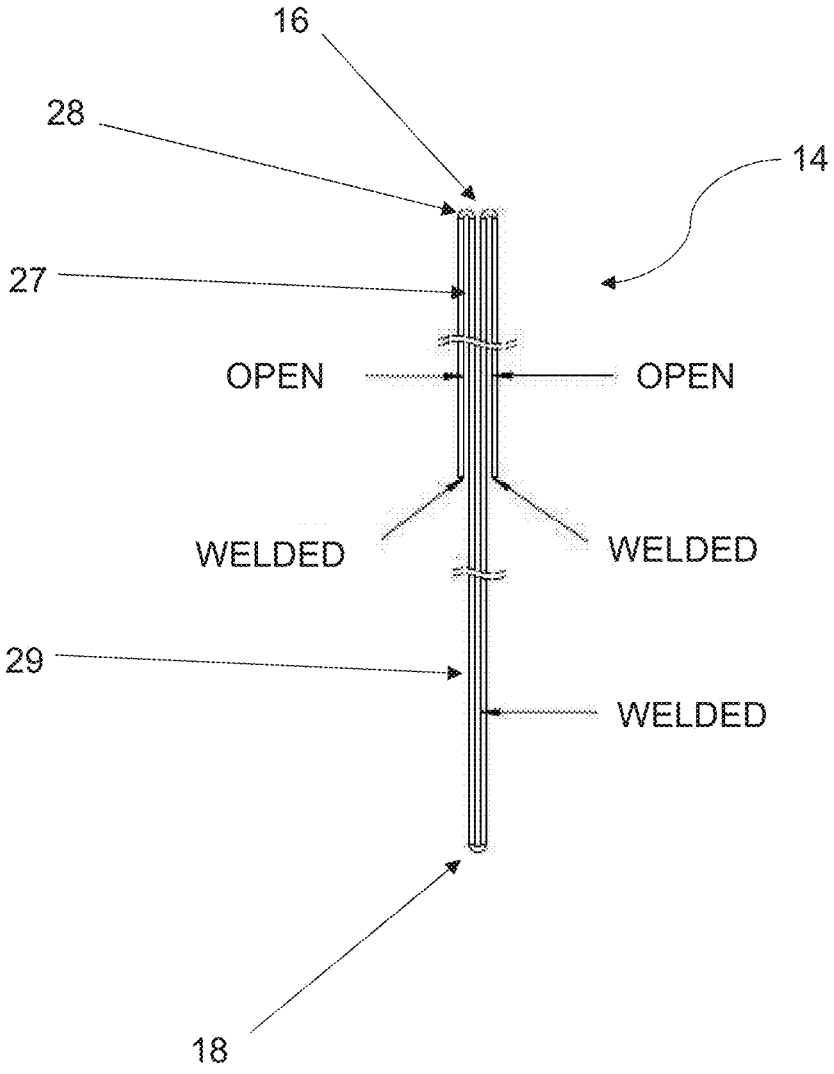
FIG. 4 shows a cut away side view of the closable bag.

Details of the closable bag 14 are shown in FIGS. 3-4. A securing element 24, in the shape of an elongate member 26, is used for securely closing the open end 16 of the closable bag 14. The securing element is positioned about the perimeter of the open end of the closable bag. In order to prevent the securing element 24 in the form of elongate member 26 from slipping from the closable bag, in some embodiments, the elongate member 26 is at least partially embedded in a neck portion 28 of the closable bag 14. Alternatively, the elongate member 26 is provided in a sealed channel 27, shown in further details in FIG. 4, provided about the perimeter of the open end 16 of the closable bag 14. At least one cut out 19 in the neck portion 28 of the closable bag 14, or in the sealed channel 27, is also provided to facilitate access to the elongate member 26.

The elongate member 26, shown in FIG. 3, is attached to the closing device 20. It will be appreciated that there are many different possible configurations for attaching the elongate member 26 to the closing device 20. Amongst these possible configurations, both the proximal and distal ends of the elongate member 26 can be attached to the closing device 20. Alternatively, only the proximal end of the elongate member 26 can be fixed to the closing device 20 whilst the distal end of the elongate member is attached to the closable bag 14. Another alternative is to attach the proximal end of the elongate member 26 to the closing device 20 while a loop member, surrounding a portion of the elongate member, is attached the distal end of the elongate member 26.

The elongate member 26 depicted in FIG. 3 can be provided in different cross-sectional shapes, different materials, and/or different forms depending on the application of the bag sealing system. These include a string, a thread, a rope, a cable, a chain, a cable tie, and a wire, among others.

The closable bag 14, shown in FIGS. 3-4, is depicted with a rectangular profile with a plain material. However, it will be appreciated that other shapes, forms and/or materials are possible depending on the application of the bag sealing system.

The sealed channel 27, shown in FIG. 4, is sealed by welding the neck portion 28 of the closable bag 14 to the walls 29 of the closable bag 14. However, other sealing methods can be substituted, such as stitching or gluing. Furthermore, whilst the sealed channel 27, shown in FIGS. 3-4, is made of the same material as the walls 29 of the closable bag 14, it will be appreciated that in some embodiments different materials can be used for the sealed channel 27 and the walls 29 of the closable bag 14.

Figure 5:
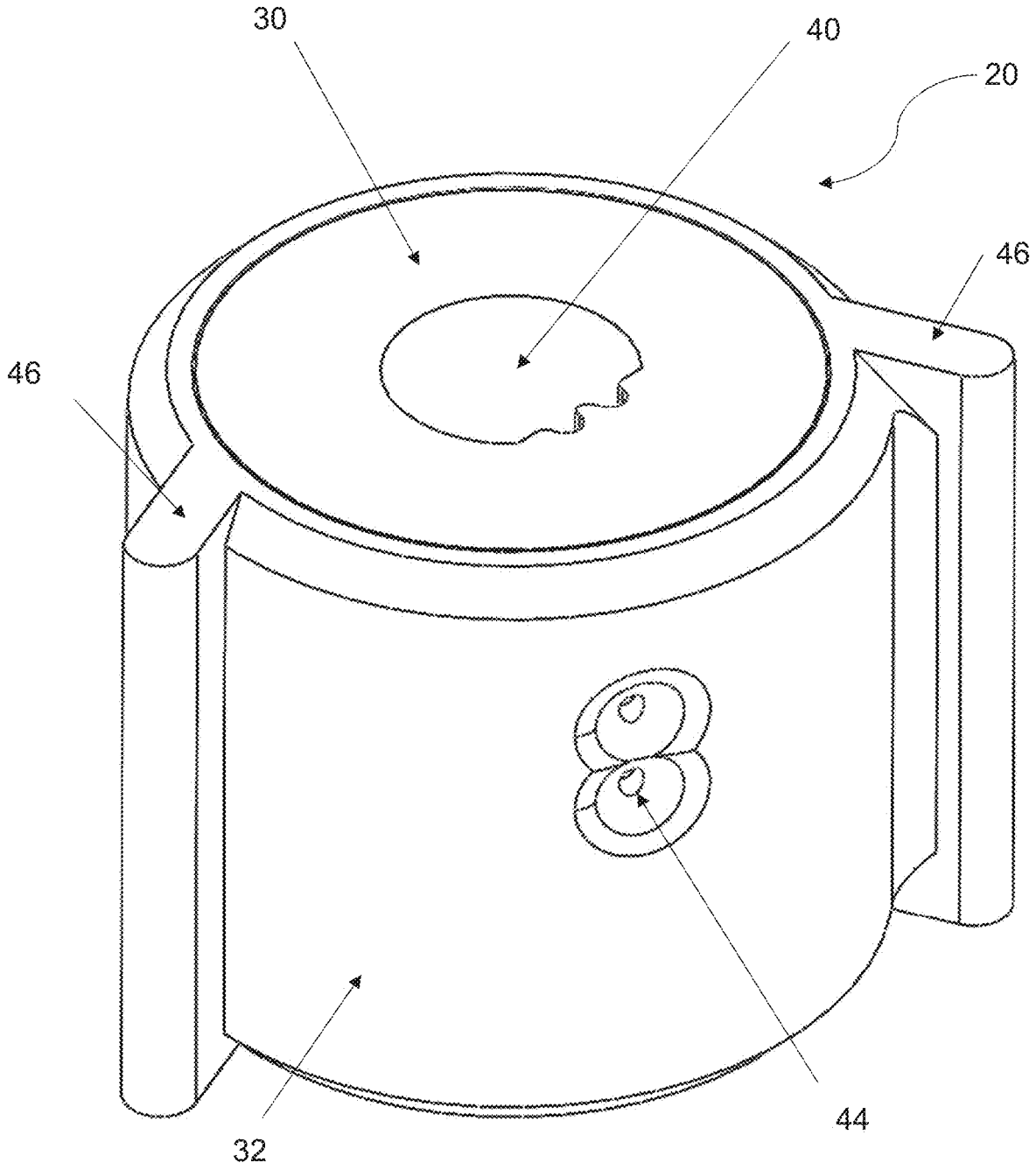
FIG. 5 shows a top perspective view of a first example of the closing device comprising a spool.

An embodiment of the closing device 20 is shown in FIG. 5. The closing device 20 comprises two parts, namely a rotatable spool 30 and a housing 32 for housing the spool 30 and for storing the securing element 24, upon rotation of the spool 30 within the housing 32. Both the housing 32 and the spool 30 can have a generally cylindrical configuration. The housing 32 comprises a pair of locking elements 46 to secure the housing 32 to the movable frame 12, especially when the rotatable spool 30 is actuated by the driving device 22. In other embodiments, the housing 32 can comprise a single locking element 46, or more than two locking elements 46, to secure the housing 32 to the movable frame 12. The spool 30 of the closing device 20 comprises a coupling element or aperture 40 for connecting the driving device 22 to the rotatable spool 30. The housing 32 comprises at least one aperture 44, allowing the elongate member 26 to pass through the housing 32. In the embodiment shown in in FIG. 5, housing 32 comprises a pair of apertures 44 spaced apart from each other.

Figure 6:
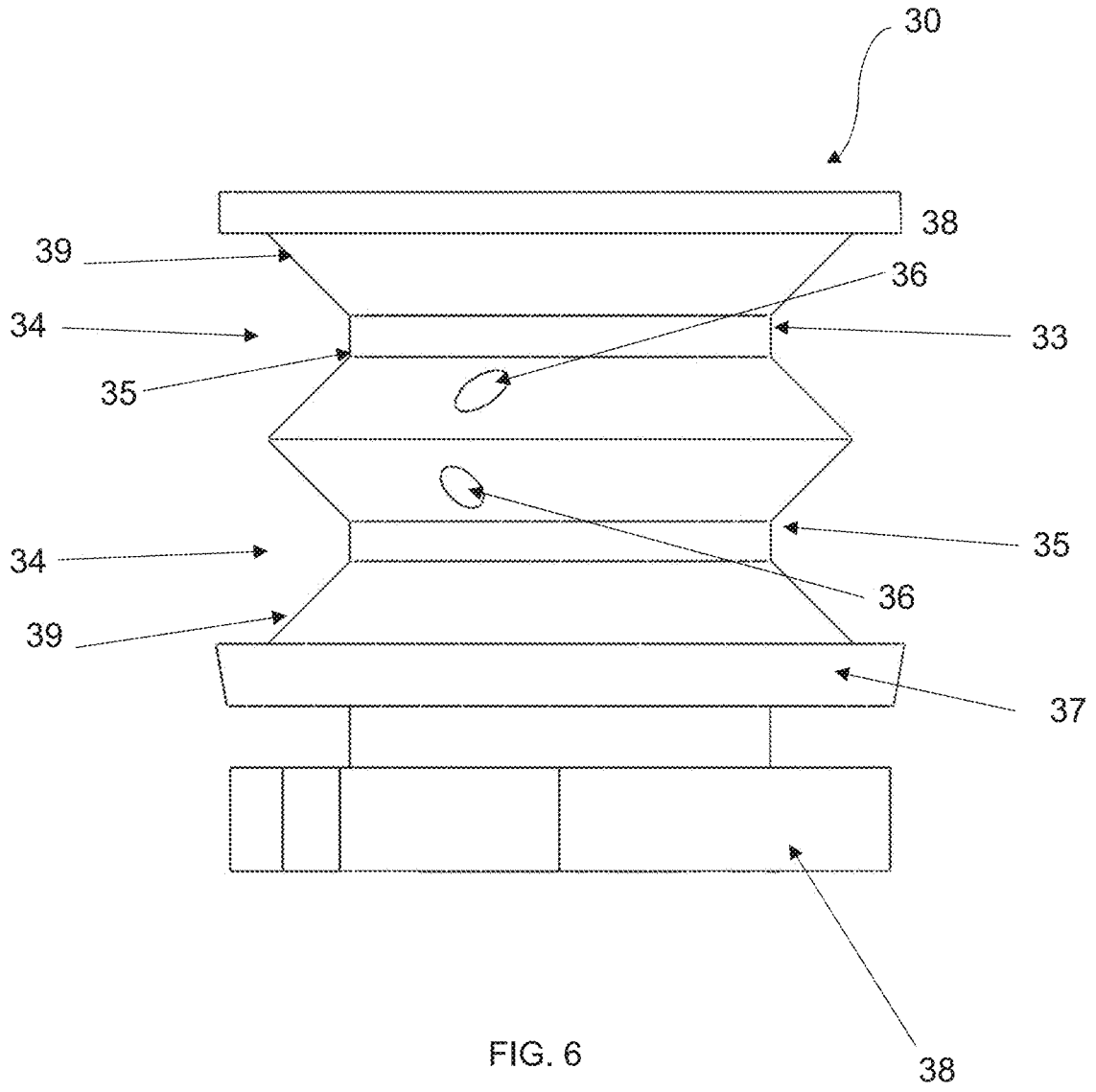
FIG. 6 shows a side view of the spool of the first example of the closing device.

The rotatable spool 30, shown in further detail in FIG. 6, comprises at least one volume, space or void in the form of at least one channel 34 about its circumference for storing the elongate member 26. In the embodiment shown in FIG. 6, the rotatable spool 30 comprises a pair of spaced apart channels 34 about the circumference of the spool for storing the elongate member 26. Each channel 34 has a tapered configuration comprising a base portion 33 and angled side walls 39 to accommodate the elongate member 26 wrapped around the channel 34 multiple times. The angled side walls 39 further enable the correct alignment of the elongate member 26, thereby ensuring that the elongate member 26 is compactly wrapped in the channel 34. Each channel 34 can comprise a recess 35 for receiving a first layer of the elongate member 26. The spool 30 comprises at least one attachment element 36 for attaching the securing element 24. In the embodiment shown in FIG. 6, the rotatable spool 30 comprises a pair of attachment elements 36 for attaching the securing element 24. Depending on the type of securing element 24, and its possible configuration, the at least one attachment element 36 can be used for attaching either the proximal end of the elongate member 26 or both the proximal and distal ends of the elongate member 26. In preferred embodiments, the at least one attachment element 36 is positioned in the middle of the at least one channel 34. The spool 30 comprises a locking member 37 for securing the rotatable spool 30 into the housing 32. The rotatable spool 30 further comprises a first set of pawls 38. This first set of pawls 38 is depicted at the bottom of the rotatable spool 30 in FIG. 6, but other positions and/or configurations of the first set of pawls 38 are possible.

In the embodiment shown in FIG. 6, the locking member 37 is a circular protrusion positioned between the at least one channel 34 and the first set of pawls 38, about the rotatable spool 30 circumference. The locking member 37 sits in a corresponding locking member receiver 43 of the housing 32, shown in FIG. 7, once the rotatable spool 30 is inserted into the housing 32. The locking member 37 has a wedged profile allowing the insertion of the rotatable spool 30 into the housing 32 but preventing removal of the spool 30 once the closing device 20 is assembled, thereby securing the closing device 20 from being tampered. It would be appreciated that other designs of the locking member 37 are possible.

Figure 7:
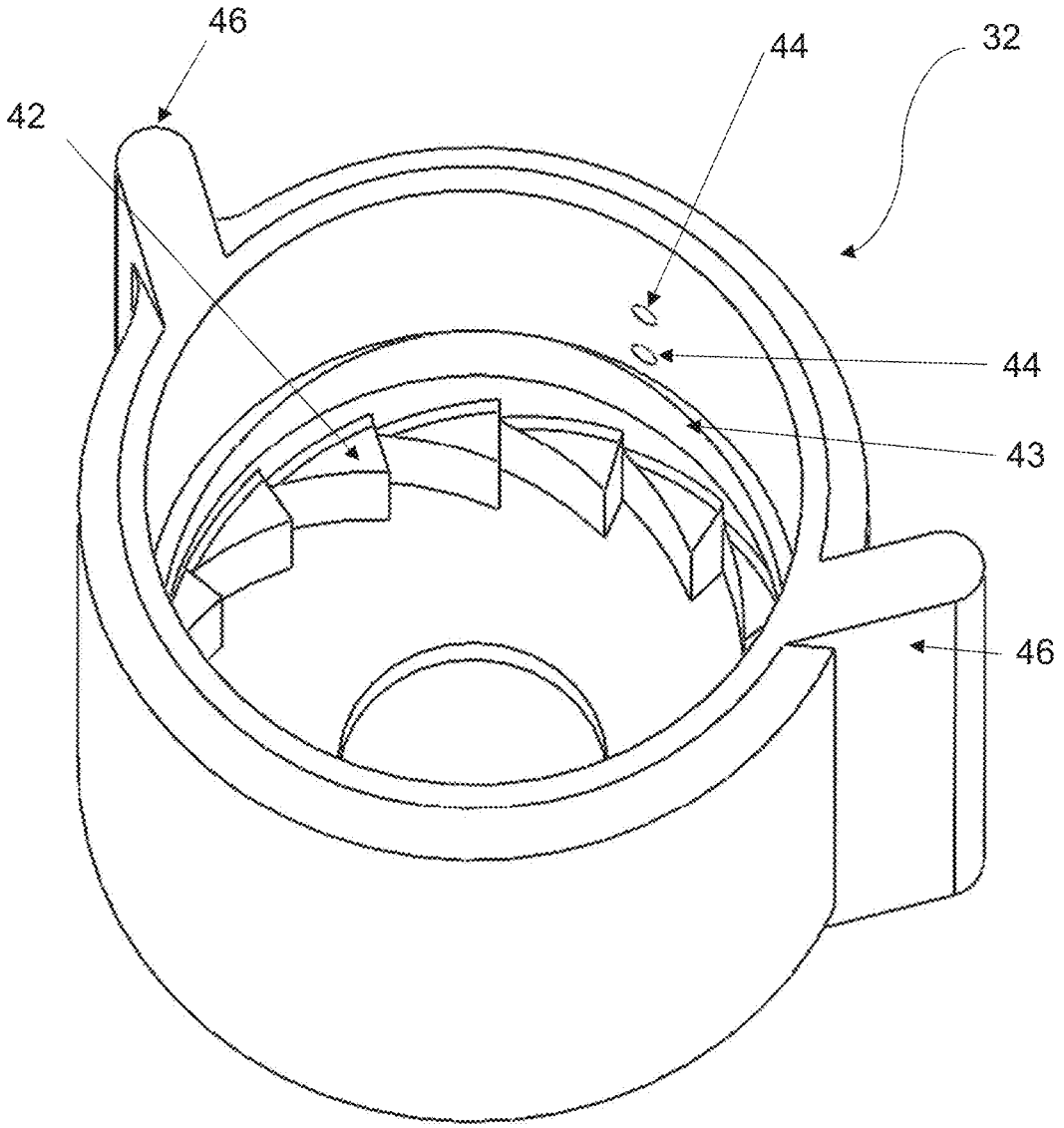
FIG. 7 shows a top perspective view of the housing without the spool of the first example of the closing device.

FIG. 7 shows details of the housing 32, set to match the rotatable spool 30. The housing comprises at least one aperture 44, allowing the elongate member 26 to pass through the housing 32. The at least one aperture 44 is positioned substantially in front of, and substantially aligned with, the at least one channel 34 and the at least one attachment element 36 of the spool 30, when the spool 30 is positioned in the housing. In the embodiment shown in FIG. 7, the housing 32 comprises a pair of spaced apart apertures 44, positioned substantially in front of, and substantially aligned with, the respective channels 34 and the respective attachment elements 36 of the spool 30, when the spool 30 is positioned in the housing. The housing 32 comprises a second set of pawls 42 which engages the first set of pawls 38 in the rotatable spool, shown in FIG. 6. In the embodiment shown, the specific configuration of the first and second sets of pawls 38, 42 allows for the rotatable spool 30 to rotate only in one direction, thereby locking the elongated member 26 into the closing device 20 upon actuation of the driving device 22, drawing the elongate member 26 into the housing 32 and thus closing the bag 14. In the embodiment shown in FIG. 7, the spool 30 is rotatable clockwise within the housing 32 but cannot be rotated anticlockwise. It would be appreciated however that other configurations of the closing device 20 can allow for the rotatable spool 30 to be rotated counter clockwise within the housing but not clockwise. In some embodiments, it is desirable for the rotatable spool 30 to be rotated both clockwise and counter clockwise within the housing 32 and/or for the spool 30 to be releasable from the housing 32. Furthermore, as previously described, the rotatable spool 30 is locked into the closing device 20 upon the locking member 37, shown in FIG. 6, entering the locking member receiver 43, thereby preventing tampering of the closing device 20.

Figure 8:
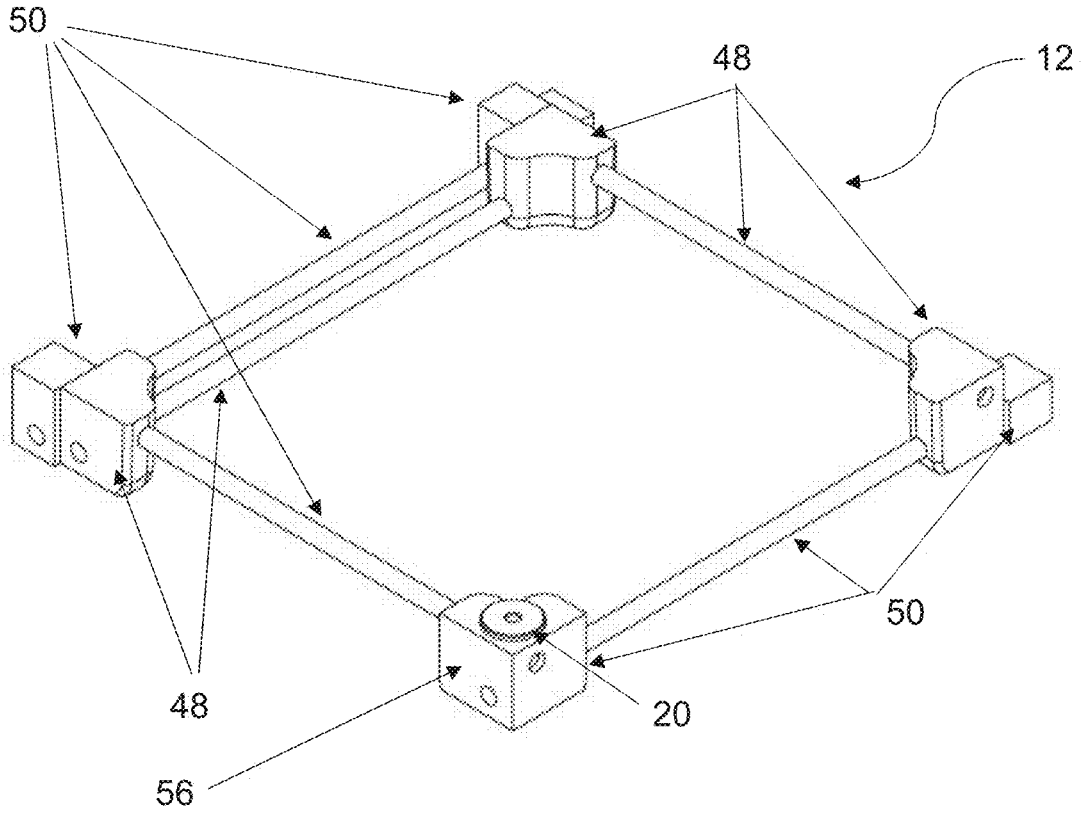
FIG. 8 shows a top perspective view of a movable frame in an open configuration.
Figure 9:
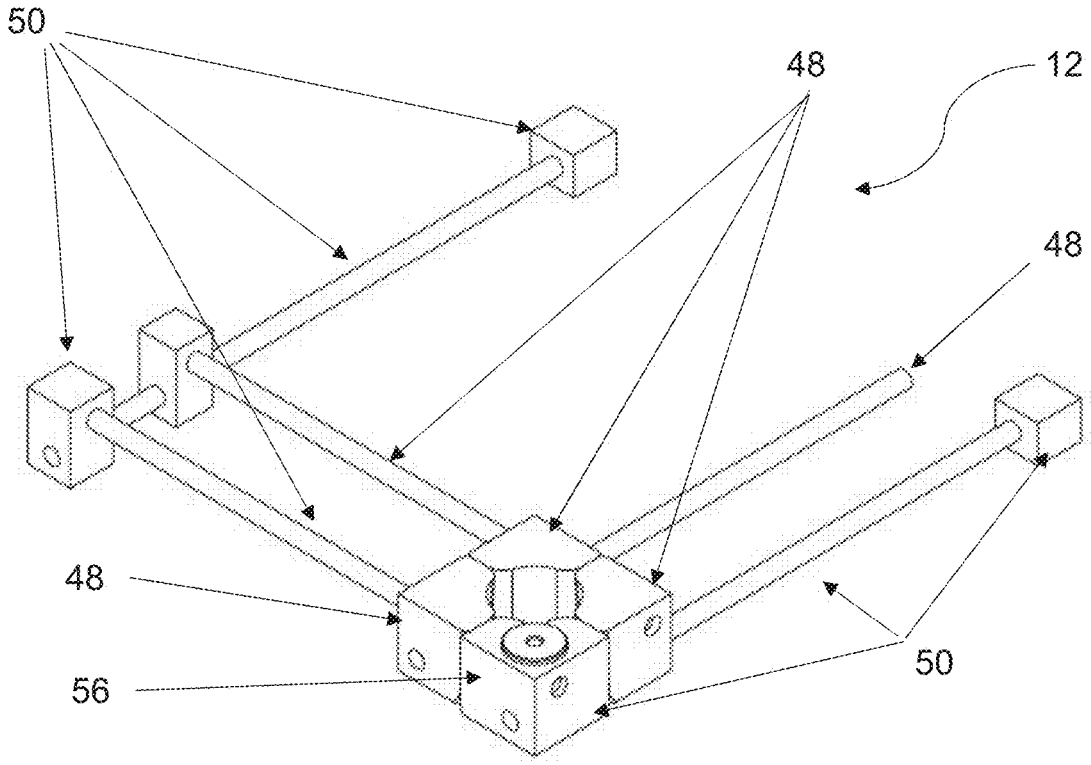
FIG. 9 shows a top perspective view of the movable frame in a closed configuration.

The movable frame 12 is depicted in further detail in FIG. 8 and FIG. 9, in its open configuration and closed configuration, respectively. The movable frame 12 includes a plurality of moveable elements 48 and a plurality of static elements 50, wherein the former move relative to the latter, thereby enabling the change of configuration of the frame 12 between the open and closed configurations. The movable frame 12 is also equipped with a closing device holder 56 comprising a substantially cylindrical aperture or recess 57 to accommodate or otherwise hold the closing device 20 and allow coupling of the securing element 24 thereto. In the embodiments shown, some of the static elements 50 are in the form of fixed rods, such as metal rods formed of aluminium, steel or other metal, which form a fixed frame along which the movable elements 48 slide. Some of the static elements 50 are in the form of fixed blocks formed of plastics, steel, or other material. In the embodiments shown, some of the moveable elements 48 are in the form of movable rods, such as metal rods formed of aluminium, steel or other metal. Some of the movable elements 48 are in the form of movable blocks formed of plastics, steel, or other material. The movable blocks, and the movable rods attached thereto, move from the open configuration to the closed configuration as the closing device 20 is activated/actuated, thus retracting the securing element 24 into the housing 32 of the closing device 20 and closing the closable bag 14.

Whilst the moveable frame 12 depicted in FIG. 8 and FIG. 9 has a quadrilateral footprint, a person skilled in the art would appreciate that other footprint shapes are possible, such as, but not limited to, a circular or elliptical footprint, depending on the application.

Figure 10:
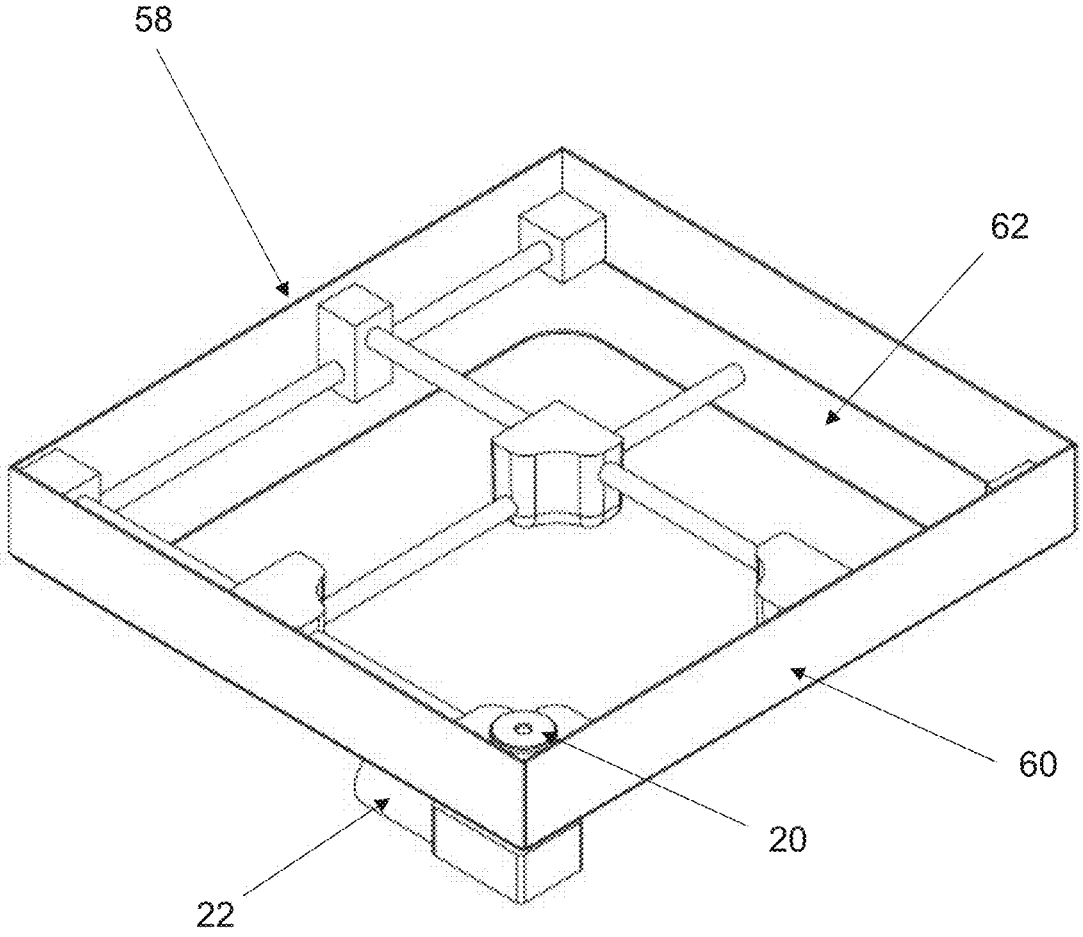
FIG. 10 shows a top perspective view of the movable frame within a mounting frame with the movable frame in an intermediate position.

The bag sealing system 10 can be advantageously arranged within a mounting frame 58 as shown in FIG. 10. The mounting frame 58 provides necessary mechanical strength and rigidity and further protects both the moveable elements 48 and static elements 50 of the movable frame 12. The mounting frame 58 can comprise side walls 60 and a base plate 62. In some embodiments, the mounting frame 58 can be connected to a support base by a telescopic post (both not shown) for adjusting the height of the bag sealing system 10. FIG. 10 shows the movable frame 12 in an intermediate position between the open configuration shown in FIG. 8 and the closed configuration shown in FIG. 9. FIG. 10 also shows the closing device 20 and the driving device 22.

Figure 11:
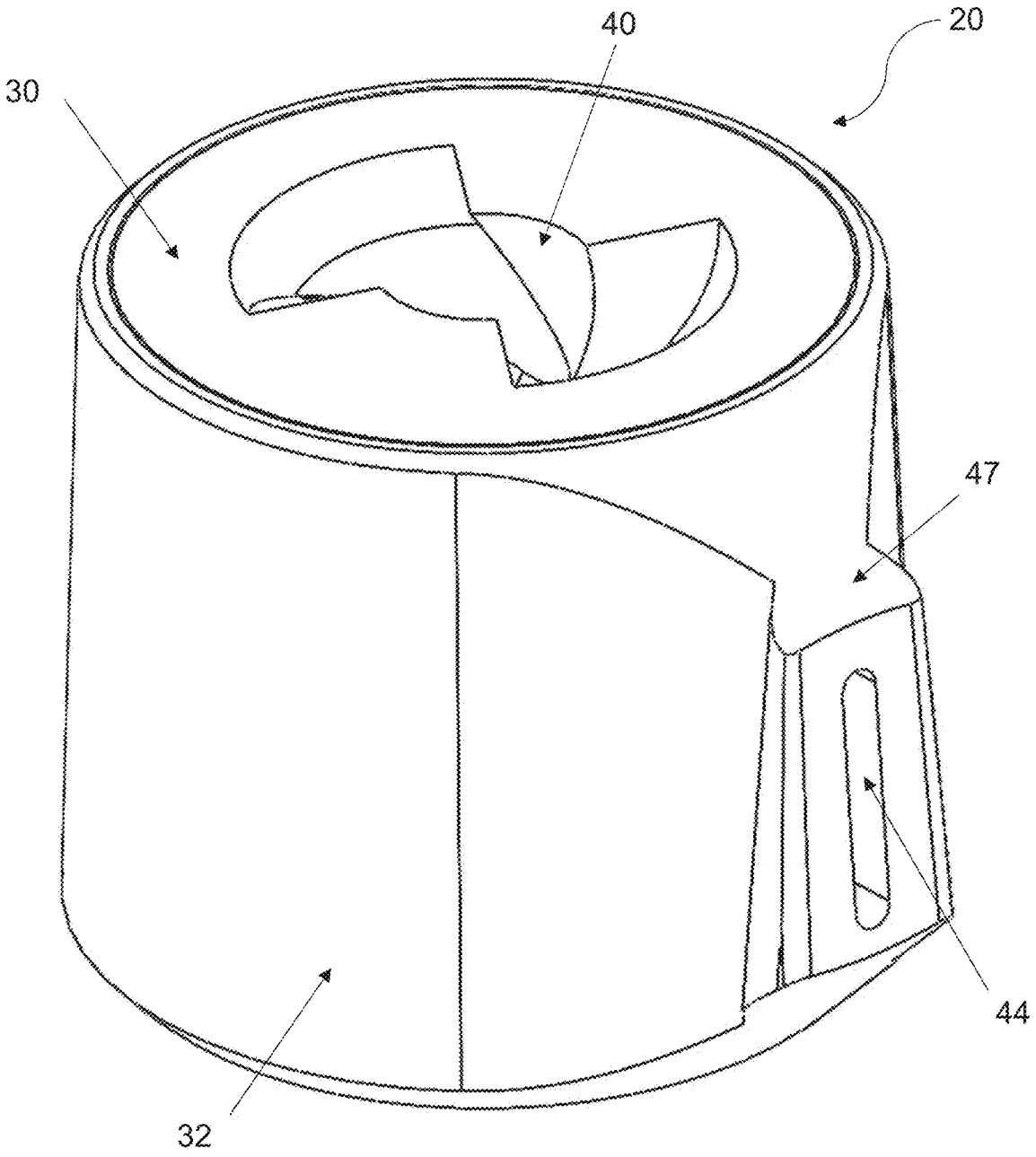
FIG. 11 shows a top perspective view of a second example of the closing device comprising a spool.

Another embodiment of the closing device 20 is shown in FIG. 11. The closing device 20 shown in FIG. 11 is also made of two parts, namely a rotatable spool 30 and a housing 32 for housing the spool 30 and for storing the elongated member 26, upon rotation of the spool 30 in the housing 32. Similarly to the previous embodiment, both the housing 32 and the spool 30 can have a generally cylindrical configuration. However, in this embodiment, the housing 32 comprises a bowtie shaped locating element 47 to prevent rotation of the housing 32 relative to the movable frame 12, especially when the rotatable spool 30 is actuated by the driving device 22. The closing device 20 also features at least one aperture 44 in the bowtie shaped locating element 47 for allowing the elongate member 26 to pass through the housing 32. In this embodiment, the aperture 44 is a slit positioned substantially in the middle of the bowtie shaped locating element 47. The closing device 20 also features a coupling element 40 for coupling the closing device 20 to the driving element 41 (see FIG. 16).

Figure 12:
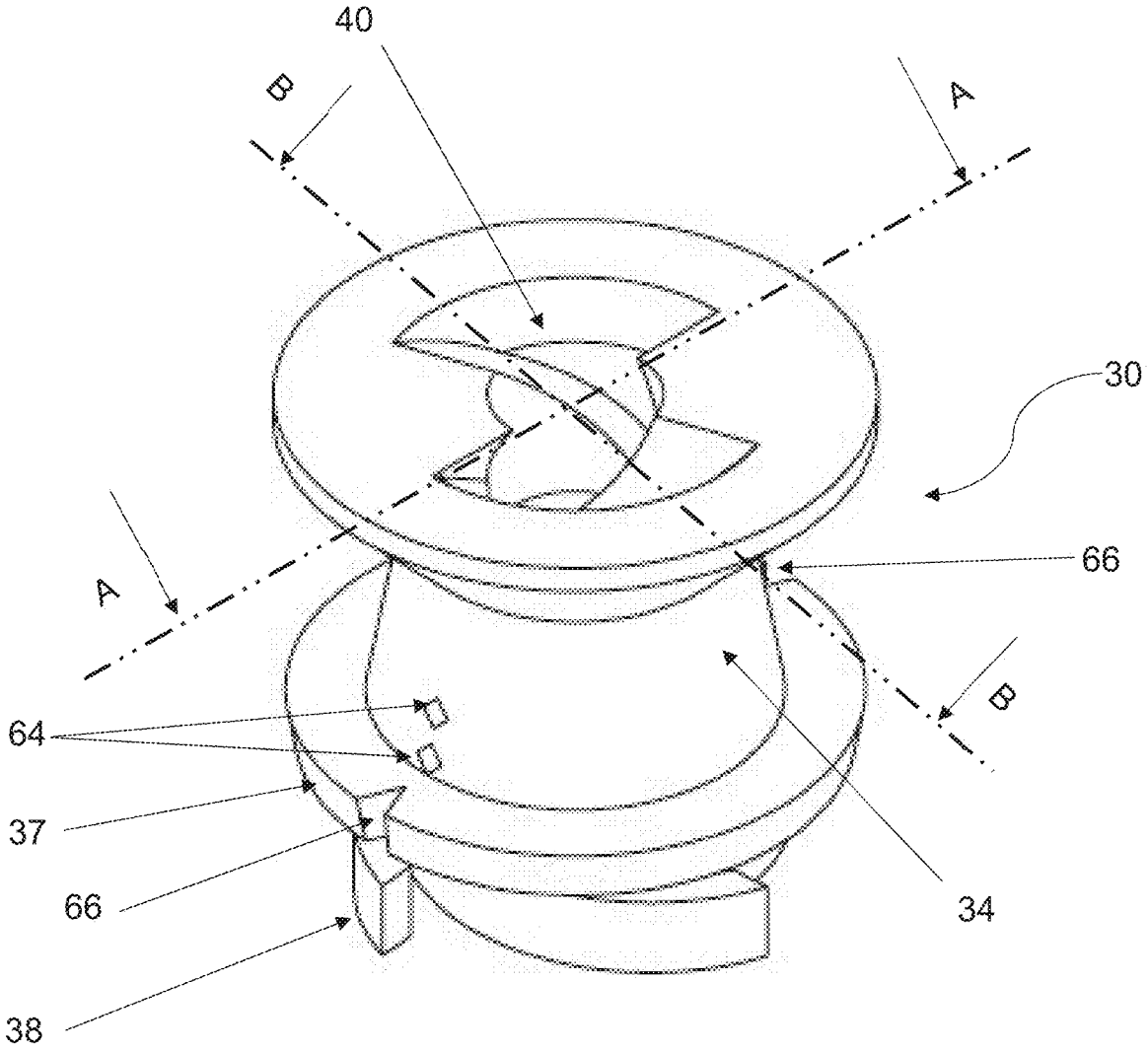
FIG. 12 shows a top perspective view of the spool of the second example of the closing device.

Further details of the rotatable spool 30 shown in FIG. 11 are provided in FIG. 12. The rotatable spool shown in FIG. 12 comprises some of the same features as the spool 30 shown in FIG. 6, such as the at least one channel 34 for storing the elongate member 26; a first set of pawls 38 at the bottom of the rotatable spool 30; a coupling element 40 for connecting the driving device 22 to the rotatable spool; and a locking member 37 for securing the rotatable spool 30 into the housing 32. In the embodiment shown in FIG. 12, the rotatable spool 30 further comprises at least one inner spool channel 64 for securing the elongate member 26 to the rotatable spool 30. Furthermore, the locking member 37 has at least one recess region 66 allowing the elongate member 26 to pass through the locking member 37 when the rotatable spool 30 is inserted into the housing 32 thereby assembling the closing device 20. The coupling element 40, for connecting the driving element 41 to the rotatable spool 30 is also shaped as a helicoidal screw. This design allows for the directionally-dependent conversion of rotation of the rotatable spool 30 to an axial force, thereby permitting both the automatic coupling and decoupling of the closing device 20 from the moveable frame 12.

Figure 13A:
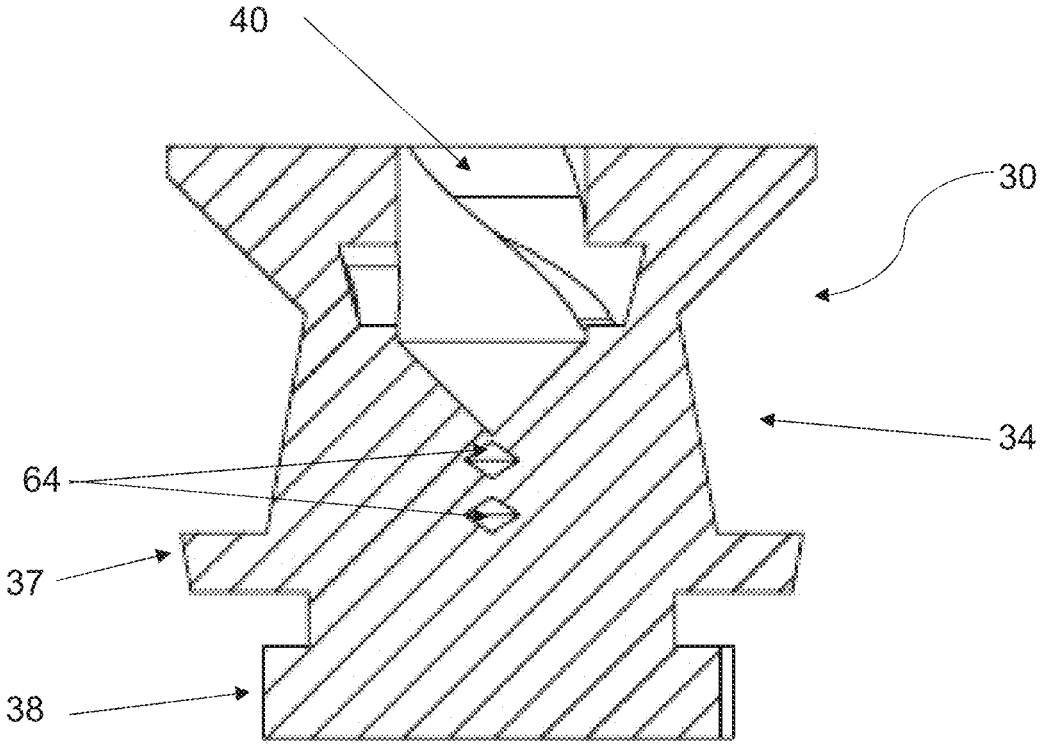
FIG. 13A shows a cross sectional view taken at line B-B of the spool shown in FIG. 12 of the second example of the closing device.
Figure 13B:
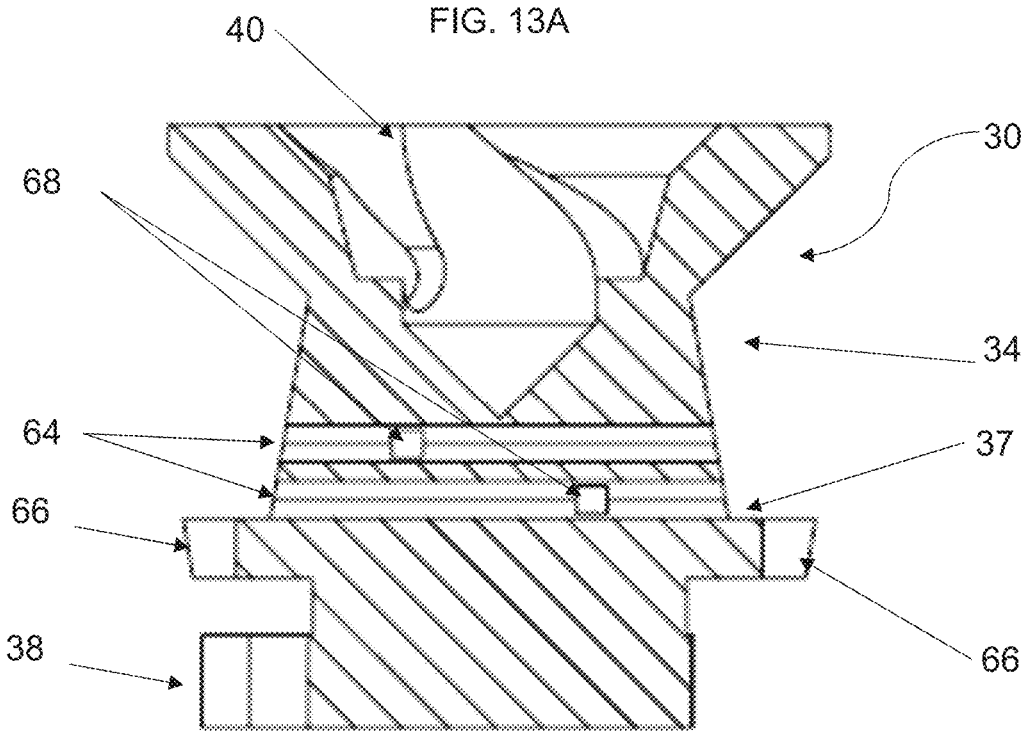
FIG. 13B shows a cross sectional view taken at line A-A of the spool shown in FIG. 12 of the second example of the closing device.

FIGS. 13A and 13B, which are cross sectional views taken at line B-B and A-A respectively as shown in FIG. 12, disclose further details of the features of the rotatable spool 30. These figures notably show the details of the inner spool channel 64, positioned between the securing member 37 and the at least one channel 34 for storing the elongate member 26. The at least one inner spool channel 64 fully traverses rotatable spool 30 and is large enough in diameter to accommodate the elongate member 26. The purpose of the at least one inner spool channel 64 is to secure the elongate member 26 to the rotatable spool 30. In the embodiment shown in FIGS. 13A and 13B, this is achieved by using at least one grappling element 68, positioned in the at least one inner spool channel 64. The grappling element 68 bends the elongate member 26 thereby creating a friction force which prevents the elongate member 26 from sliding through the at least one inner spool channel 64. It would be appreciated that there are many different methods for securing the elongate member 26 to the rotatable spool 30, for example using ferrules, adhesive, retaining teeth or friction due to tighter inner channels.

Figure 14A:
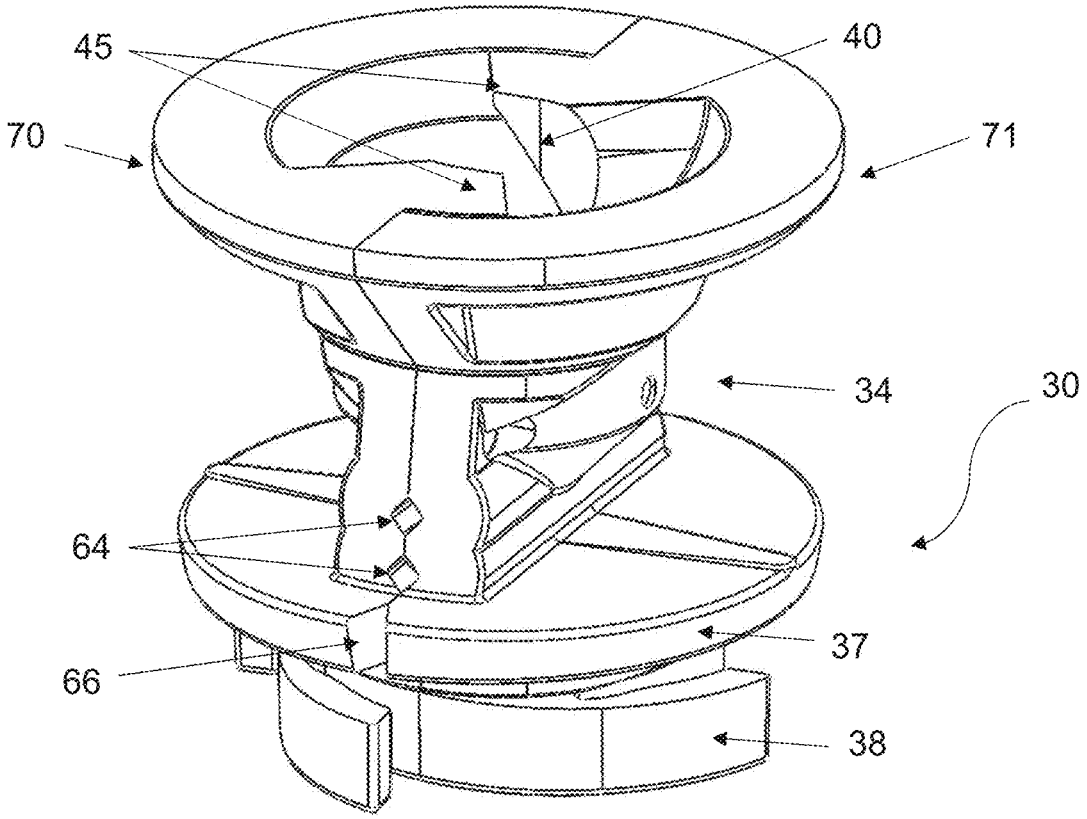
FIG. 14A shows a top perspective view of another example of a spool.
Figure 14B:
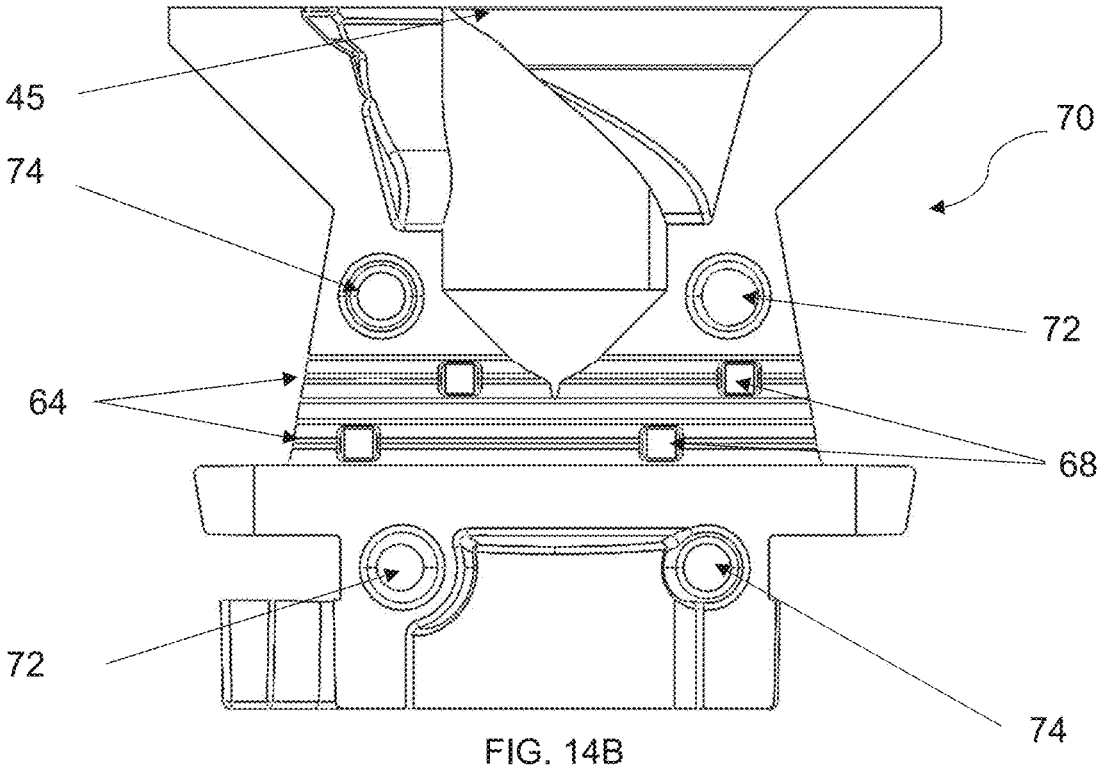
FIG. 14B shows a side view of half of the spool shown in FIG. 14A.

Another embodiment of the rotatable spool 30 is shown in FIGS. 14A and 14B. The rotatable spool shown in FIGS. 14A and 14B comprises some of the same features as the spool 30 shown in FIG. 12, such as the at least one channel 34 for storing the elongate member 26; a first set of pawls 38 at the bottom of the rotatable spool 30; a coupling element 40 for connecting the driving device to the rotatable spool; and a locking member 37 for securing the rotatable spool 30 into the housing 32. In the embodiment shown in FIG. 14A, the rotatable spool 30 is separated into two distinct halves 70 and 71. The extended tooth 45 of each half permits the smooth transformation of torque via the coupling element 40 by preventing the need for a parting along its length. Here the grappling elements 68 for securing the elongate member 26 to the rotatable spool 30 have been enlarged, which allows for easily positioning the elongate member 26 into the inner channel 64. FIG. 14B shows a side view of the rotatable spool half 70, wherein alignment studs 72 and corresponding alignment recesses 74 are provided for promoting alignment of the two rotatable spool halves 70, 71 upon assembly. It would be appreciated that other features facilitating the alignment of the two rotatable spool halves can be substituted for the alignment studs 72 and corresponding alignment recesses 74.

Figure 15A:
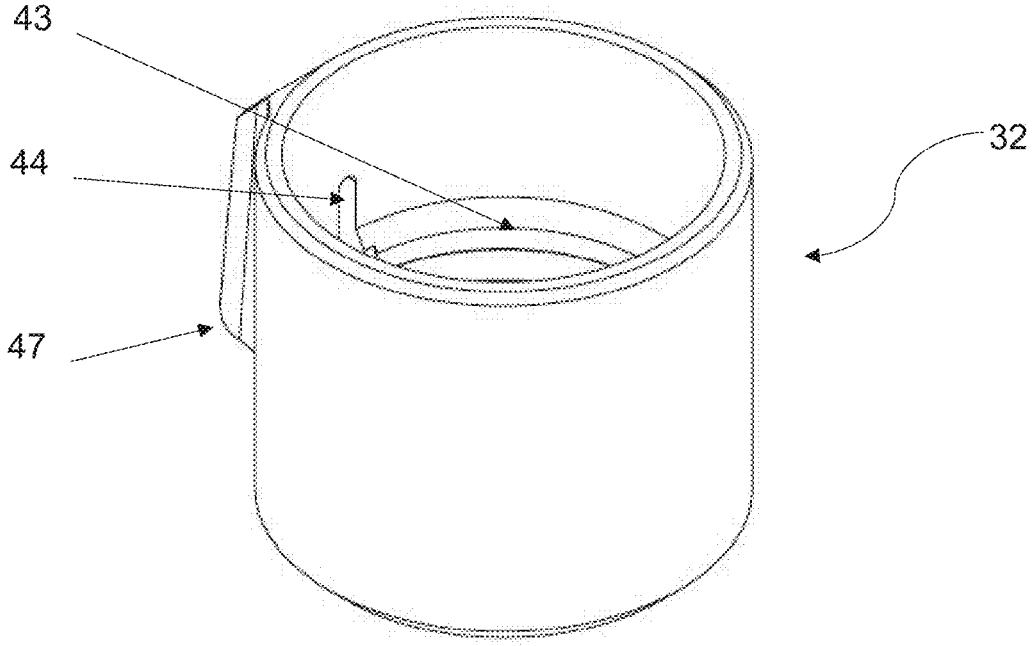
FIG. 15A shows a top perspective view of the housing without the spool of the second example of the closing device.
Figure 15B:
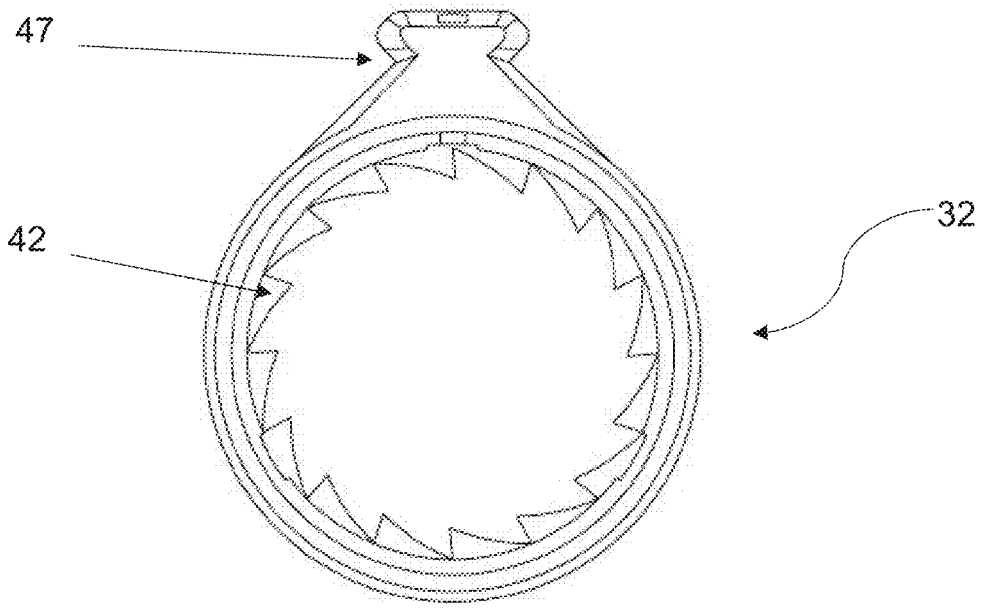
FIG. 15B shows a top plan view of the housing without the spool of the second example of the closing device.

FIGS. 15A and 15B show details of the housing 32, set to match the rotatable spool 30 disclosed in the embodiment of the closing device 20 shown in FIG. 11. The housing comprises at least one aperture 44, allowing the elongate member 26 to pass through the housing 32. The at least one aperture 44 is positioned substantially in front of, and substantially aligned with, the at least one channel 34 and the at least one inner spool channel 64 of the spool 30, when the spool 30 is in the housing. In the embodiment shown in FIG. 15A, the at least one aperture 44 is a slot, positioned substantially in front of, and substantially aligned with, the respective channel 34 and the at least one inner spool channel 64 of the spool 30. The housing 32 comprises a second set of pawls 42, shown in FIG. 15B, which engages the first set of pawls 38 in the rotatable spool 30, shown in FIG. 12. In the embodiment shown, the specific configuration of the first and second sets of pawls 38, 42 allows for the rotatable spool 30 to rotate only in one direction, thereby locking the elongated member 26 into the closing device 20 upon actuation of the driving device 22, drawing the elongate member 26 into the housing 32 and thus closing the bag 14. It would be appreciated, however, that other configurations of the closing device 20 can allow for the rotatable spool 30 to be rotated in a counter clockwise direction only, or in both clockwise and counter clockwise directions, and/or to allow the spool 30 to be released from the housing 32. Furthermore, as previously described, the rotatable spool 30 is locked into the closing device 20 upon the locking member 37, shown in FIG. 12, entering the locking member receiver 43, thereby preventing tampering of the closing device 20.

Figure 16:
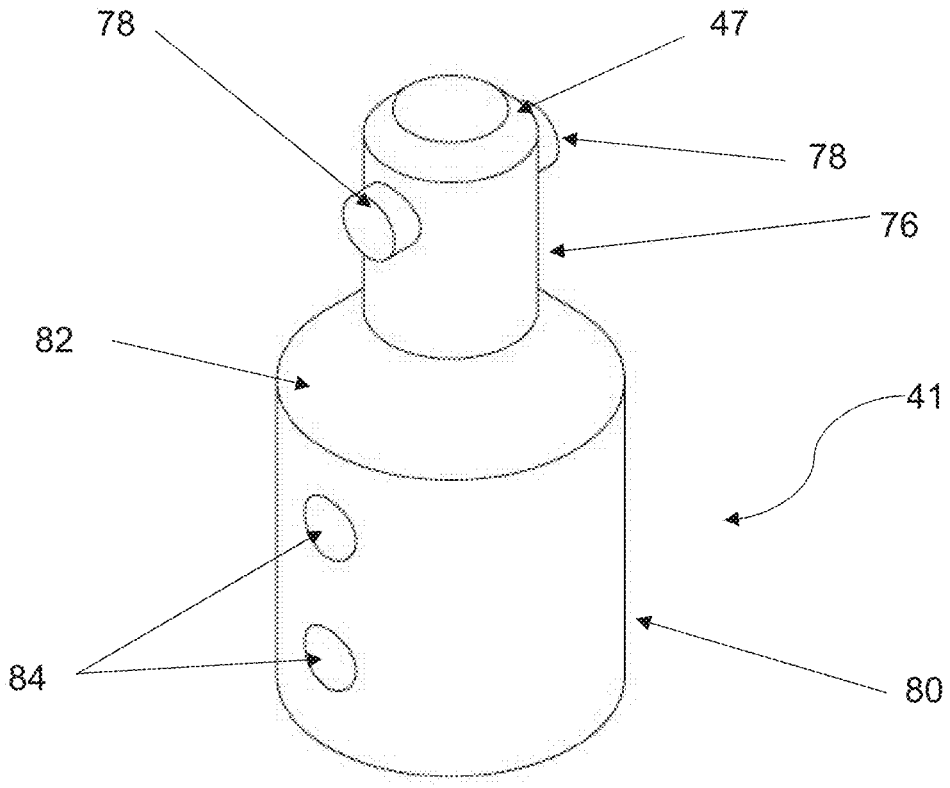
FIG. 16 shows a top perspective view of a coupling element for coupling the driving device to the second example of the closing device.

FIG. 16 provides details of a driving element 41 for coupling the driving device 22 to the rotatable spool 30. The driving element 41 comprises a first substantially cylindrical element 76, with two substantially cylindrical protrusions 78, such as for example spring or coiled spring pins, positioned orthogonally to the first cylindrical element 76 and located in the upper portion of the first cylindrical element 76. The first cylindrical element 76 is connected to, or extends from a second substantially cylindrical element 80, with a larger diameter than the first substantially cylindrical element 76, through a tapered section 82. The second cylindrical element 80 comprises at least one connection element 84 such as for example grub screws for connecting to the driving device. This specific arrangement allows connection of the first cylindrical element 76 to the helicoidal shaped coupling element 40 shown in FIGS. 11-13B.

Figure 17:
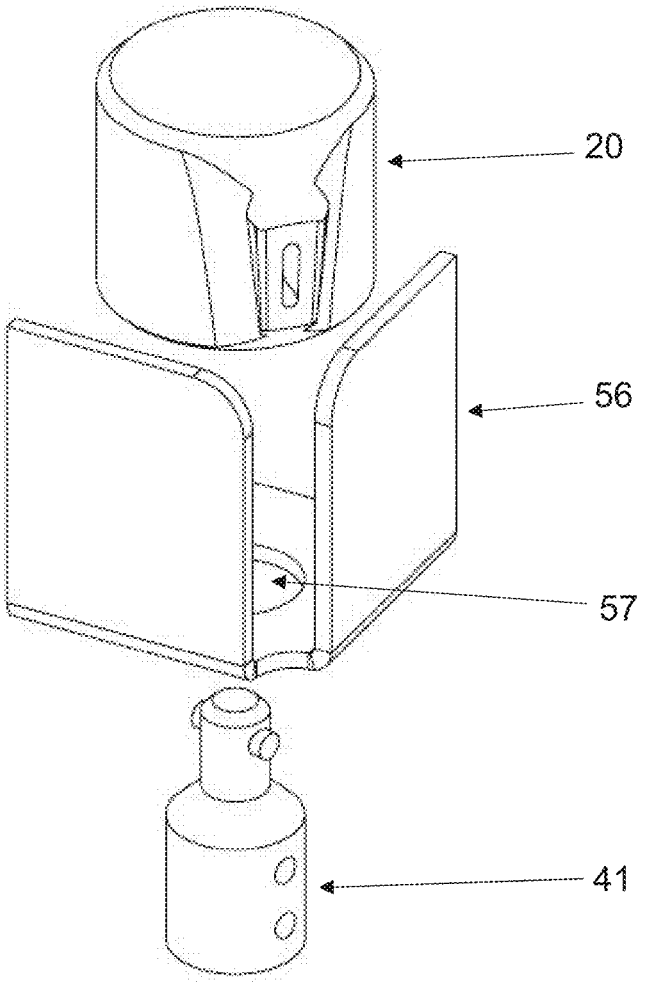
FIG. 17 shows an exploded view of the second example of the closing device with the coupling element and a closing device holder.

FIG. 17 shows the assembly of the closing device 20 to the closing device holder 56 provided on the movable frame 12 and the driving element 41 for coupling the driving device 22 to the rotatable spool 30 via the substantially cylindrical aperture or recess 57.

Figure 18:
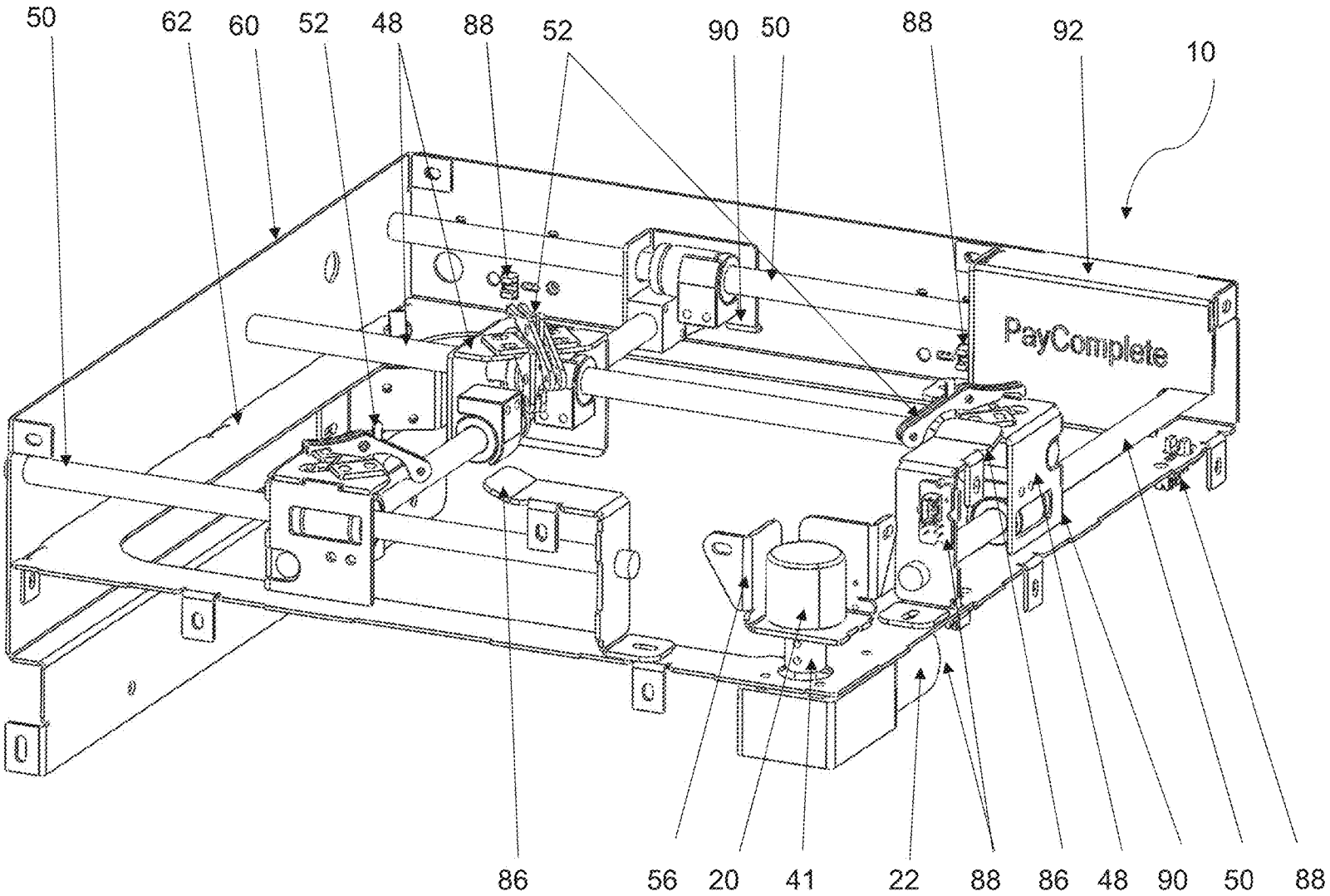
FIG. 18 shows a top perspective view of the bag sealing system.

FIG. 18 shows an overview of the bag sealing system 10 for securing one or more items in a closable bag 14. In addition to the features disclosed in FIGS. 8-10, FIG. 18 provides further details on the actuation and controls of the bag sealing system 10 for securing one or more items in a closable bag 14 and the sensors implemented for monitoring whether the movable frame 12 is open, closed or in any intermediate state. In the embodiment disclosed in FIG. 18, the bag sealing system 10 for securing one or more items in a closable bag 14 further comprises triggering elements 86, for triggering the release of the elongate member 26 from the plurality of securing parts 52. It would be appreciated that in some embodiments at least one triggering element 86 is provided for each securing part 52. Alternatively, in other embodiments, the opening of at least one securing part 52 can be triggered by the tension applied on the elongate element 26 once the movable frame 12 has transitioned from its open configuration shown in FIG. 1 to its closed configuration shown in FIG. 2. A person skilled in the art would also appreciate that the triggering elements 86 are positioned in such a way that they will trigger the release of the elongate element 26 from the securing parts 52 only when the movable frame 12 is fully closed, as shown in FIG. 9.

The bag sealing system 10 for securing one or more items in a closable bag 14 shown in FIG. 18 also comprises a plurality of sensors for monitoring the position and/or displacement of the plurality of moveable elements 52. Such sensors include for example current sensors (not shown) for measuring the driving device 22 torque and/or load, encoders (not shown), optical sensors 88 with their respective triggering elements 90 allowing to infer if the moveable frame is open or closed, or any combination of sensors thereof. It would be appreciated that other sensing technologies enabling the determination of the position of the moveable parts 48 can be implemented.

A controlling element 92, for example an onboard computer, is provided for collecting and analysing the data from the aforementioned sensors, and in response actuate the driving device 22. It would be appreciated that the functions performed by the controlling element 92 can also be done remotely, wherein the sensors are in wired or wireless communication with a remote computer. Furthermore, the controlling element 92 can also be configured for allowing communication with remote electronic devices thereby enabling an operator of the bag sealing system 10 to monitor and/or control the bag sealing system 10 remotely.

A plurality of securing parts 52, shown previously in FIGS. 1 and 2 connected to the movable elements 48, are provided for securing the securing element 24 of the closable bag 14 to the movable frame 12. Such securing parts 52 can be, for example, securing hooks 54, crocodile clips or single-use piercing elements. Furthermore, in some embodiments, the securing parts 52 can be self-releasing to automatically release the securing element 24 upon closing of the closable bag 14.

Figure 19A:
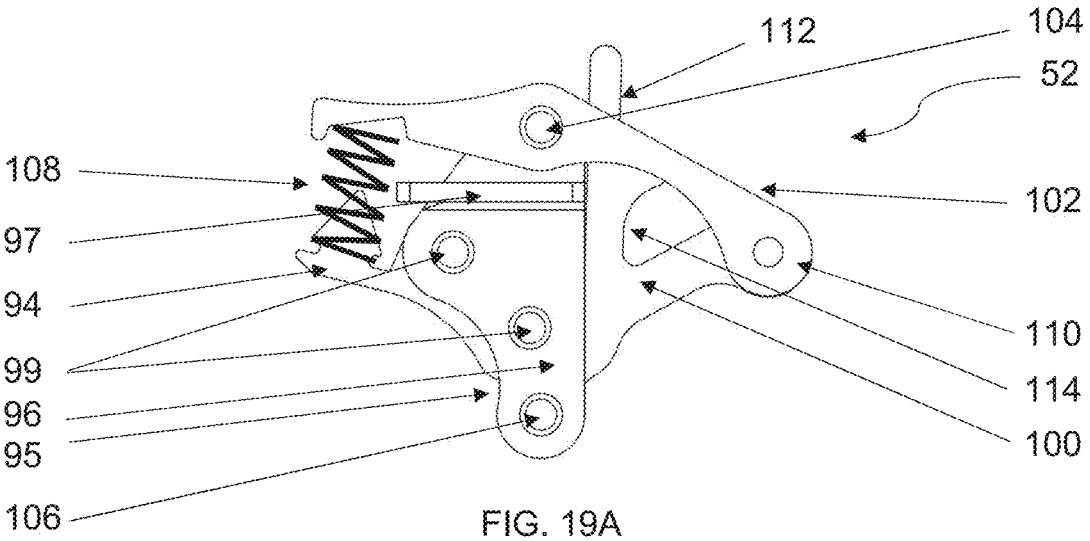
FIG. 19A shows a side view of a securing hook in a loaded position.
Figure 19B:
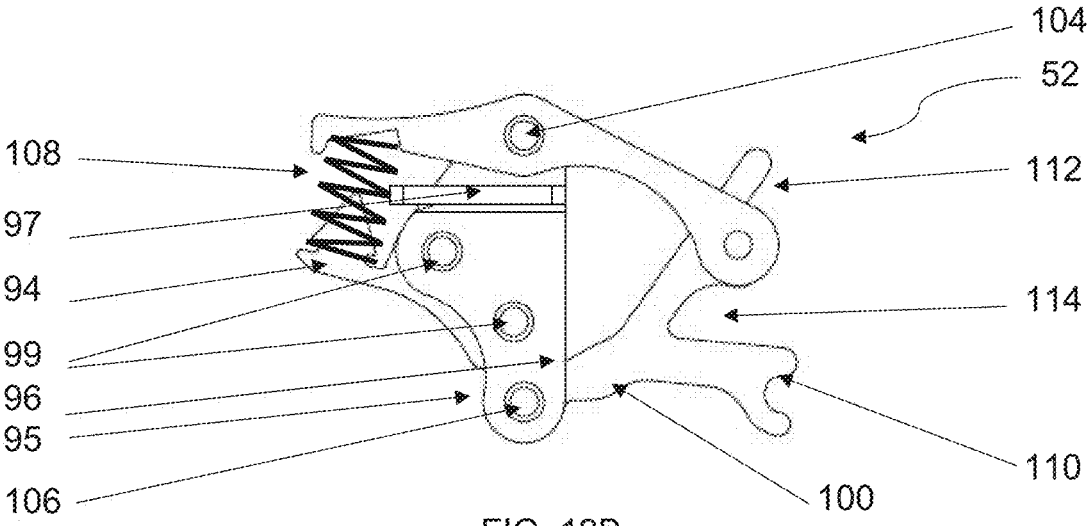
FIG. 19B shows a side view of the securing hook in a partially unloaded position.
Figure 19C:
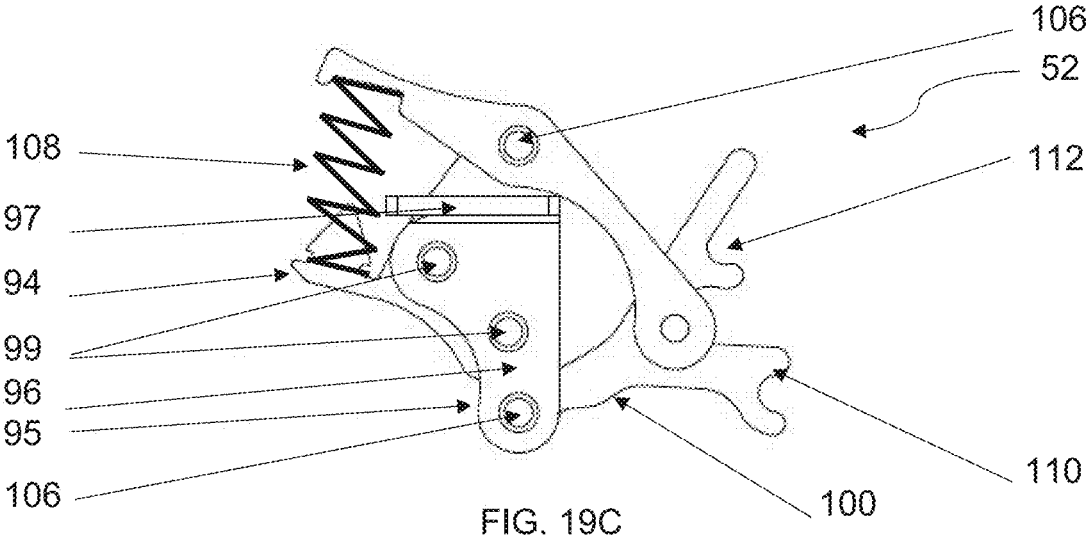
FIG. 19C shows a side view of the securing hook in a fully unloaded position.
Figure 20:
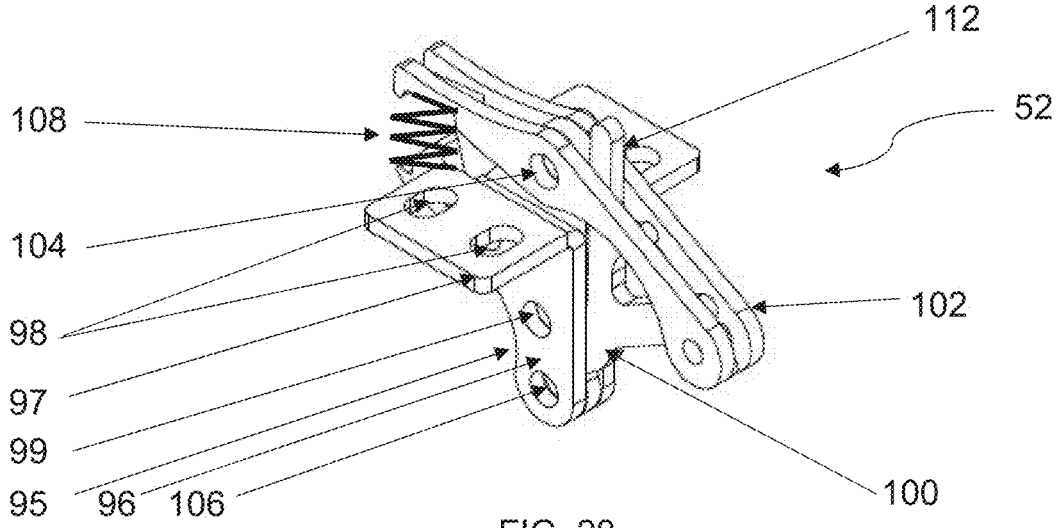
FIG. 20 shows a top perspective view of the securing hook in the loaded position.

FIGS. 19A, 19B and 19C provide further details of the securing element 52, in its loaded position, intermediate position and unloaded position respectively, whilst FIG. 20 shows a top perspective view of the securing element 52, in its loaded position. The securing element 52 comprises a spine element 94 and at least one fastening element 95. The at least one fastening element 95 is L-shaped with a first section 96 parallel to the spine element 94 and a second section 97 perpendicular to the spine element 94. The second section 97 of the fastening element 94 further comprises at least one securing aperture 98 (visible in FIG. 20), for securely attaching the securing element to one of the plurality of moveable elements 48, as shown in FIG. 18. The first section 96 of the fastening element 95 also comprises at least one fastening member 99 for securing the fastening element 95 to the spine element 94. The securing element 52 further comprises a hook member 100 and a latch member 102. The latch member 102 is connected to the upper portion of the spine element 94 with a pin 104 whilst the hook member 100 is connected to the lower portion of the first section 96 of the fastening element 95 with a pin 106. Both the pins 106 and 104 enable the hook member 100 and latch member 102 to rotate about the axes of the pins 106 and 104 respectively. The securing element 52 also comprises a biasing element 108, such as a helical spring, positioned between the distal ends of the lower hook member 100 and latch member 102, thereby providing mechanical biasing between the hook member 100 and latch member 102. The proximal end of the lower hook member 100 comprises two prongs 110 and 112, shaped for receiving the proximal end of the latch member 102. Upon loading the elongate member 26, the securing member 52 is partially loaded as shown in FIG. 19B, by partially compressing the biasing element 108 and positioning the proximal end of the latch member 102 in the prong 112, thereby enabling access to the gap 114 between the prongs 110 and 112. The elongate member 26 is then positioned in the gap 114 between the prongs 110 and 112. The securing member 52 is then fully loaded by further compressing the biasing element 108 and positioning the proximal end of the latch member 102 in the prong 110, as shown in FIG. 19A, thereby securing the elongate member 26 in the securing member 52.

Figure 21:
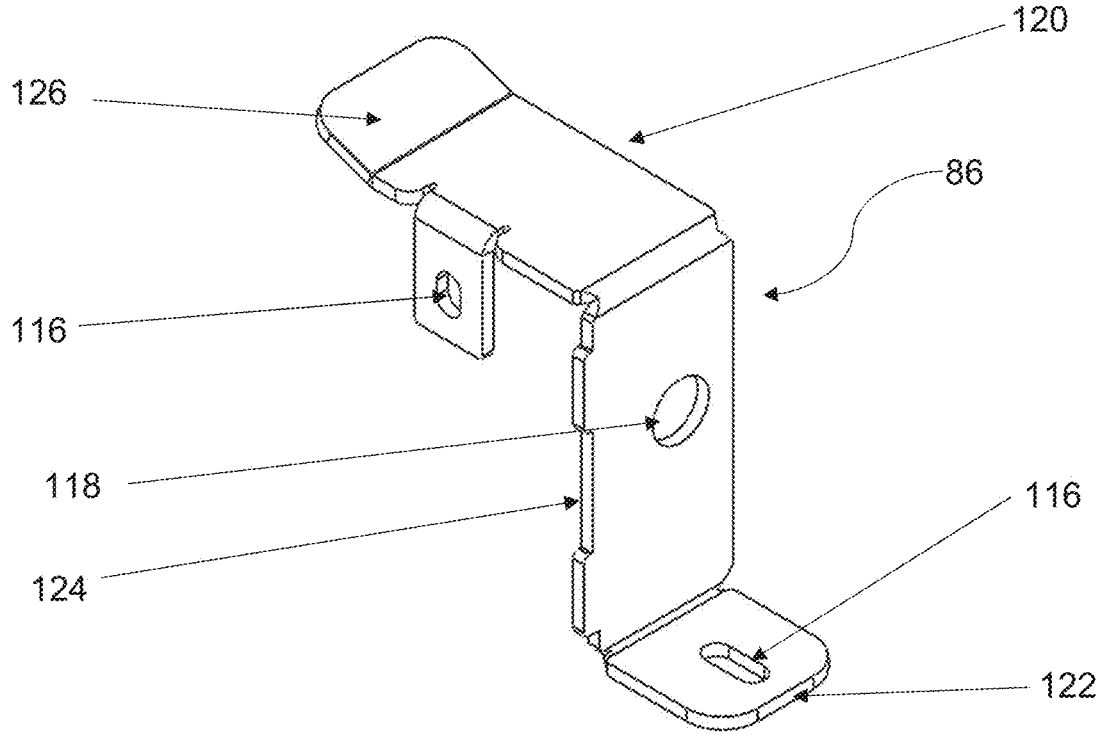
FIG. 21 shows a top perspective view of a triggering element.

FIG. 21 depicts an embodiment of the triggering member 86, which purpose is to trigger the release of the elongated member 26 from the securing member 52 upon physical contact. The triggering member 86 comprises a plurality of securing apertures 116 for securing the triggering element to the side walls 60 of mounting frame 58, as shown in FIG. 18. Advantageously an aperture 118 for securing some of the static elements 50 in the form of fixed rods is also provided. The triggering member 86 further comprises two substantially horizontal body plates 120 and 122, connected at their proximal ends by a substantially vertical body plate 124. The distal end of the upper body plate 120 is connected to a triggering plate 126 which is substantially angled from the upper body plate 120 in such a way that once the securing element 52 meets the triggering element, the triggering plate 126 hits the upper portion of the distal end of the latch member 102. As the securing element 52 moves further toward the triggering element 86, the slope of the triggering plate 126 further pushes the distal end of the latch member 102 downward thereby lifting the proximal end of the latch member from the prong 110 and further compressing the biasing element 108. Consequently, the elongate member 26 is released from the gap 114 between the prongs 110 and 112 by gravity or the tension within the elongate member 26 itself, thereby enabling the automatic release of the closable bag 14 from the moveable frame 12.

Figure 22A:
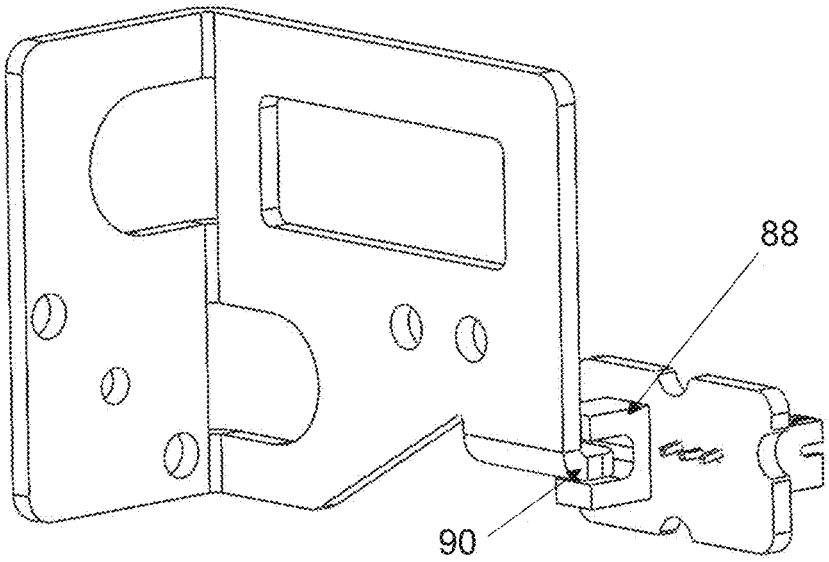
FIG. 22A shows a top perspective view of an optical sensor element and an optical triggering element.
Figure 22B:
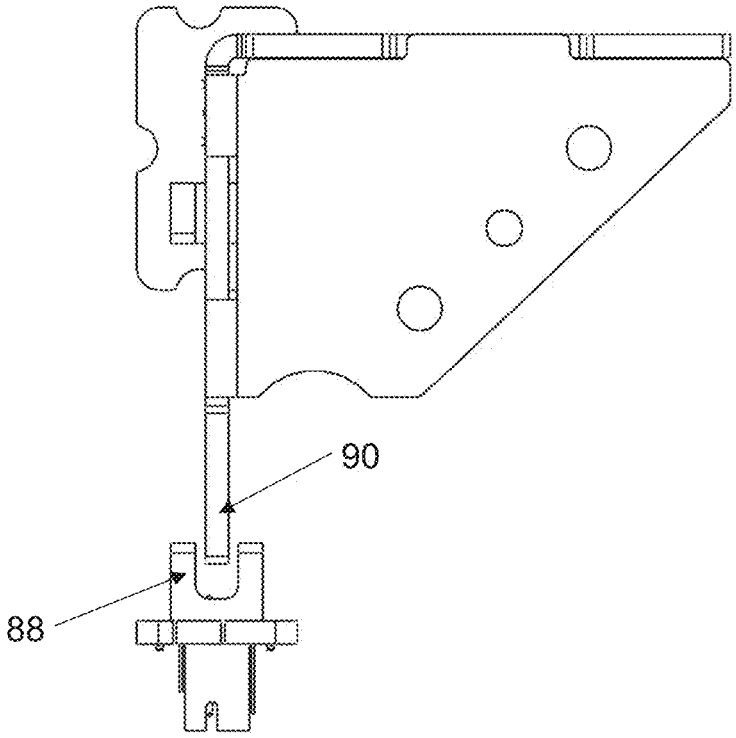
FIG. 22B shows a rear plan view of another optical sensor element and another optical triggering element.

Embodiments of the plurality of optical sensors 88 and their corresponding optical sensors triggering element 90 are shown in FIGS. 22A and 22B. The sensor triggering element 90 is a protrusion which, once inserted in the optical sensor 88, blocks the optical pathway of the optical sensor 88 thereby creating a sensing event recorded by the controlling element 92. Advantageously, the optical sensors 88 are secured to the side walls 60 of the mounting frame 58, at the extremities of the running course of the movable frame, whilst the sensor triggering elements 90 are positioned on the moveable elements 48 in such a way that the triggering of the optical sensors 88 occurs when the moveable frame 12 is fully open or fully closed. Other optical sensors 88 and sensor triggering elements 90 can be implemented to detect any configuration of the movable frame 12.

Figure 23:
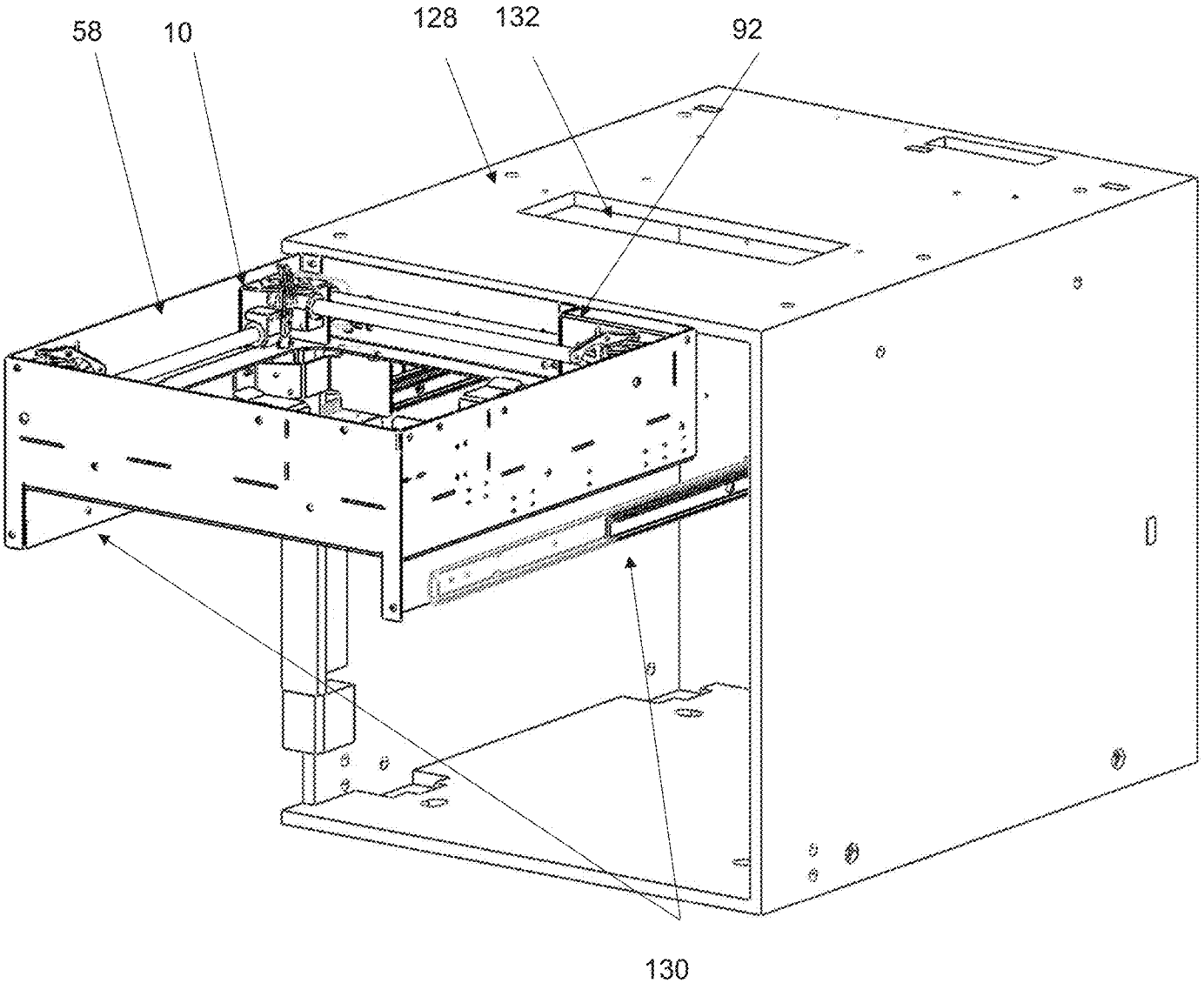
FIG. 23 shows a perspective environmental view of the bag sealing system for securing one or more items in a closable bag in an embodiment of use.

Another embodiment of the bag sealing system 10 is shown in FIG. 23 wherein the bag sealing system is implemented in a safe deposit box 128. The bag sealing system 10 is attached to rails 130, positioned on either side of the bag sealing system 10, underneath the mounting frame 58, enabling for the bag sealing system 10 to be effortlessly inserted or withdrawn from the safe deposit box. Once the safe deposit box 128 is closed and the bag sealing system 10 fully inserted into the safe deposit box (configuration not shown), a user can deposit currency or other valuables through the open slit 132 in the safe deposit box, positioned above the open end of the closable bag (not shown). Closing of the closable bag can be actioned remotely through remote communications with the controlling element 92 or triggered by the opening of the safe door, thereby preventing the operator of the bag sealing system 10 from tampering with the contents of the closable bag. To further prevent tampering with the contents of the closable bag, once the action of closing the closable bag has been initiated, the controlling element 92 can delay the opening of the door of the safe deposit box until the closable bag is fully closed. Alternatively, the operator can open the safe deposit box 128 to inspect the contents of the closable bag and manually trigger the action of closing the closable bag.

The operation of the bag sealing system 10 involves receiving one or more items in the closable bag 14. Actuation of the closing device 20 by the driving device 22 causes rotation of the spool 30 within the housing 32. A portion of the securing element 24 around the open end of the bag 14 is withdrawn and stored around the spool 30 inside the housing 32 of the closing device 20, thereby securely closing the closable bag 14. Advantageously, as the bag 14 is being closed, the movable frame 12 is also transitioning from its open configuration to its closed configuration.

Advantages of some embodiments of the present invention include providing a system and a method for securely sealing a closable bag for securing one or more items which is adaptable to a variety of applications. The securing element, which in some embodiments can be a string, a thread, a rope, a cable, a chain, a cable tie or a wire, is part of the closable bag. The closing device, actuated by a driving device, stores the securing element, thereby enabling the closable bag to be securely closed. The securing element is locked inside the closing device itself once stored, thereby preventing its release. Therefore, the only method for opening the closable bag once closed is to cut the bag open. Consequently, an operator trying to access the contents of the closable bag once closed would not be able to do so unnoticed.

Those skilled in the art will appreciate that not all of the above advantages are necessarily exhibited by all embodiments of the present invention.

Any of the features described herein can be combined in any combination with any one or more of the other features described herein within the scope of the present invention and in the context of the specific feature.

Throughout the specification the aim has been to describe the invention without limiting the invention to any one embodiment or specific collection of features. Persons skilled in the relevant art may realize variations from the specific embodiments that will nonetheless fall within the scope of the invention.

The invention claimed is:

1. A bag sealing system for securing one or more items in a closable bag, the system comprising:
- a moveable frame, having an open configuration and a closed configuration;
- a closable bag having an open end and a closed end wherein the open end of the closable bag is coupled to the moveable frame;
- a closing device for securely closing the open end of the bag; and
- a driving device coupled to the closing device to actuate the closing device to securely close the closable bag, wherein actuation of the closing device to securely close the closable bag moves at least part of the moveable frame from the open configuration to the closed configuration.

2. The bag sealing system of claim 1, wherein the closable bag comprises a securing element for securely closing the open end of the closable bag.

3. The bag sealing system of claim 2, wherein the securing element is an elongate member provided about a perimeter of the open end of the closable bag.

4. The bag sealing system of claim 3, wherein the elongate member is at least partially embedded in a neck portion of the closable bag.

5. The bag sealing system of claim 4, wherein a distal end of the elongate member is attached to the closable bag and a proximal end of the elongate member is attached to the closing device.

6. The bag sealing system of claim 4, wherein a loop member is provided at the distal end of the elongate member; and
- wherein the loop member surrounds a portion of the elongate member in between the proximal and distal ends of the elongate member; and
- wherein the proximal end of the elongate member is attached to the closing device.

7. The bag sealing system of claim 4, wherein both a distal end and a proximal end of the elongate member are attached to the closing device.

8. The bag sealing system of claim 3, wherein the elongate member is provided in a sealed channel provided about the perimeter of the open end of the closable bag.

9. The bag sealing system of claim 3, wherein the elongate member is selected from a group including a string, a thread, a rope, a cable, a chain, a cable tie and a wire.

10. The bag sealing system of claim 2, wherein the closing device comprises a rotatable spool in a housing for storing a portion of the securing element.

11. The bag sealing system of claim 10, wherein the rotatable spool comprises one or more of the following:
- at least one channel about a circumference of the rotatable spool for storing the securing element;
- at least one attachment element for attaching the proximal end of the securing element or both the proximal and distal ends of the securing element, wherein the at least one attachment point is provided in the at least one channel;
- a first set of pawls;
- a coupling element for coupling to the driving device.

12. The bag sealing system of claim 11, wherein the housing comprises one or more of the following:
- at least one aperture for allowing the securing element to pass through the housing, and wherein the at least one aperture is provided substantially in front of the at least one channel;
- a second set of pawls, wherein the first set of pawls engages with the second set of pawls;
- a locking element for locking the housing to the moveable frame.

13. The bag sealing system of claim 1, wherein the driving device is selected from a group including an electric motor, a magnetic actuator or a manual actuator.

14. The bag sealing system of claim 1, wherein the movable frame comprises one or more of the following:
- a plurality of moveable elements;
- a plurality of static elements, wherein the plurality of moveable elements are movable relative to the plurality of static elements;
- a plurality of securing parts with securing hooks for receiving a securing element, wherein the plurality of securing parts are connected to the plurality of moving elements;
- a closing device holder wherein the closing device holder is connected to the closing device and the driving device.

15. The bag sealing system of claim 14, wherein the open configuration of the movable frame has a quadrilateral footprint.

16. A bag sealing system for securing one or more items in a closable bag, the system comprising:
- a moveable frame, having an open configuration and a closed configuration;
- a closable bag having an open end and a closed end wherein the open end of the closable bag is coupled to the moveable frame;
- a closing device for securely closing the open end of the bag; and a driving device coupled to the closing device to actuate the closing device to securely close the closable bag, wherein the closable bag comprises a securing element for securely closing the open end of the closable bag; and wherein the closing device comprises a rotatable spool in a housing for storing a portion of the securing element; and wherein the rotatable spool comprises one or more of the following:

at least one channel about a circumference of the rotatable spool for storing the securing element;

at least one attachment element for attaching the proximal end of the securing element or both the proximal and distal ends of the securing element, wherein the at least one attachment point is provided in the at least one channel;

a first set of pawls;

a coupling element for coupling to the driving device; and wherein the housing comprises one or more of the following:

at least one aperture for allowing the securing element to pass through the housing, and wherein the at least one aperture is provided substantially in front of the at least one channel;

a second set of pawls, wherein the first set of pawls engages with the second set of pawls;

a locking element for locking the housing to the moveable frame; and wherein the rotatable spool is rotatable in the housing only in one direction.

17. A bag sealing system for securing one or more items in a closable bag, the system comprising:

a moveable frame, having an open configuration and a closed configuration;

a closable bag having an open end and a closed end wherein the open end of the closable bag is coupled to the moveable frame;

a closing device for securely closing the open end of the bag; and a driving device coupled to the closing device to actuate the closing device to securely close the closable bag; wherein the movable frame comprises one or more of the following:

a plurality of moveable elements;

a plurality of static elements, wherein the plurality of moveable elements are movable relative to the plurality of static elements;

a plurality of securing parts with securing hooks for receiving a securing element, wherein the plurality of securing parts are connected to the plurality of moving elements;

a closing device holder wherein the closing device holder is connected to the closing device and the driving device; and wherein the securing hooks for receiving the securing element are self-releasing to release the securing element upon closing the closable bag.

18. A method of securing one or more items in a bag in a bag sealing system, the method comprising the steps of:

receiving the one or more items in a closable bag having an open end and a closed end, wherein the open end of the closable bag is coupled to a moveable frame;

actuating a closing device with a driving device thereby storing a portion of a securing element of the closable bag in the closing device to securely close the closable bag, wherein closing the closable bag moves the moveable frame from an open configuration to a closed configuration.

19. A closing device for closing a closable bag, the closing device comprising:

a housing having at least one aperture allowing passage therethrough of a securing element, and a spool rotatable in the housing for storing a portion of the securing element, the spool comprising at least one aperture for receiving the securing element, wherein:

the spool comprises two half portions;

the spool comprises at least one inner spool channel for securing the securing element to the spool;

the spool comprises a coupling element for connecting a driving element to the spool;

the coupling element is shaped as a helicoidal screw;

the spool comprises a first set of pawls which engage with a second set of pawls on an inside of the housing allowing the spool to rotate in the housing only in one direction; and further comprising:

a locking member for securing the spool into the housing; and at least one recess region provided in the locking member allowing the securing element to pass through the locking member when the spool is inserted into the housing.

20. A closable bag for securing contents, the closable bag comprising:

an open end and a closed end;

a securing element positioned for securely closing the open end of the closable bag, wherein the securing element is provided about a perimeter of the open end of the closable bag;

a housing having at least one aperture allowing passage therethrough of a securing element; and a spool rotatable in the housing comprising a first set of pawls which engage with a second set of pawls on an inside of the housing allowing the spool to rotate in the housing only in one direction.

21. The closable bag of claim 20, further comprising:

a locking member for securing the spool into the housing;

at least one recess region provided in the locking member allowing the securing element to pass through the locking member when the spool is inserted into the housing.

* * * * *